United States Patent [19]

Morell et al.

[11] Patent Number: 4,901,455

[45] **Date of Patent: * Feb. 20, 1990**

[54] ALPINE SKI BOOT

[75] Inventors: Joseph Morell, Annecy; Jean-Louis De Marchi, Duingt; Norbert Kopp, Chavanod, all of France

[73] Assignee: Salomon, S.A., Annecy Cedex, France

[ * ] Notice: The portion of the term of this patent subsequent to Sep. 13, 2005 has been disclaimed.

[21] Appl. No.: 184,781

[22] Filed: Apr. 22, 1988

Related U.S. Application Data

[62] Division of Ser. No. 870,374, Jun. 4, 1986, Pat. No. 4,769,930.

[30] Foreign Application Priority Data

Jun. 12, 1985 [FR] France ..... 8509180

[51] Int. Cl.[4] ..... A43B 5/04

[52] U.S. Cl. ..... 36/117; 36/120

[58] Field of Search ..... 36/117–121, 36/105

[56] References Cited

U.S. PATENT DOCUMENTS

| | | | |
|---|---|---|---|
| 3,713,231 | 1/1973 | Mochizuki . | |
| 3,718,995 | 3/1973 | Graup . | |
| 4,095,356 | 6/1978 | Robran et al. | 36/121 |
| 4,186,501 | 2/1980 | Salomon | 36/121 |
| 4,381,613 | 5/1983 | Lederer | 36/121 |
| 4,455,768 | 6/1984 | Salomon | 36/121 |
| 4,577,420 | 3/1986 | Petrini et al. | 36/121 |
| 4,620,380 | 11/1986 | Aldinio | 36/121 |
| 4,624,065 | 11/1986 | Maboux et al. | 36/120 |
| 4,653,205 | 3/1987 | Koch | 36/117 |
| 4,685,225 | 8/1987 | Hensler | 36/120 |
| 4,769,930 | 9/1988 | Morell et al. | 36/117 |

FOREIGN PATENT DOCUMENTS

| | | | |
|---|---|---|---|
| 0172159 | 2/1986 | European Pat. Off. | 36/117 |
| 2096248 | 2/1972 | France . | |
| 2103171 | 4/1972 | France . | |
| 2480575 | 10/1981 | France . | |
| 2484800 | 12/1981 | France . | |
| 2539278 | 7/1984 | France | 36/117 |
| 2564710 | 11/1985 | France | 36/117 |

*Primary Examiner*—James Kee Chi

*Attorney, Agent, or Firm*—Sandler & Greenblum

[57] ABSTRACT

A ski boot including an upper journalled on a rigid shell base around a journal axis so that the upper can undergo forward flexion around the journal axis in response to forward flexion of the leg of the skier. Also provided is a flexion control device which elastically opposes forward flexion of the upper. The flexion control device is an elastic element positioned between the shell base and the upper and extends transversely to the longitudinal axis of the boot. One end of the elastic element is attached to the shell base at a linkage point spaced from the journal axis. Another portion of the elastic element is attached to the lower edge of the cuff at a support point by a retention element. These attachments are such that during forward flexion: the distance from the journal axis to the support is invariant, the distance from the journal axis to the linkage point is invariant, and the distance from the support point to the linkage point varies.

51 Claims, 8 Drawing Sheets

Fig. 1
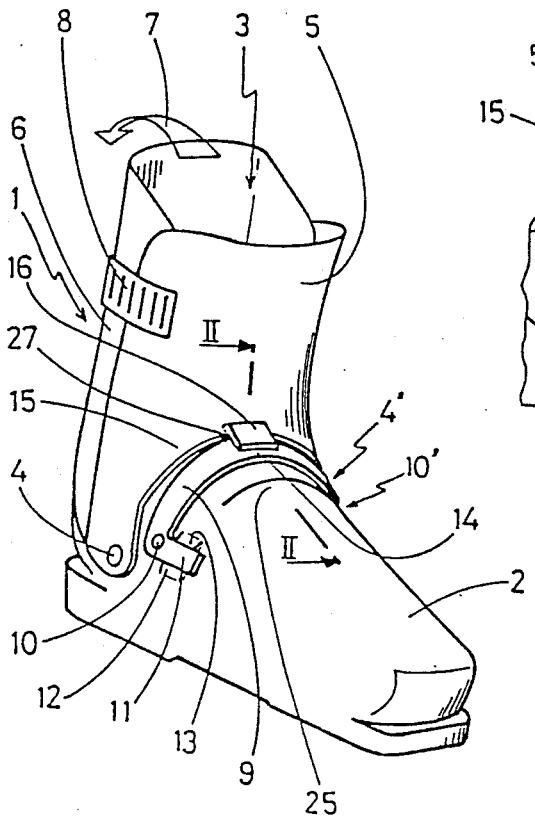
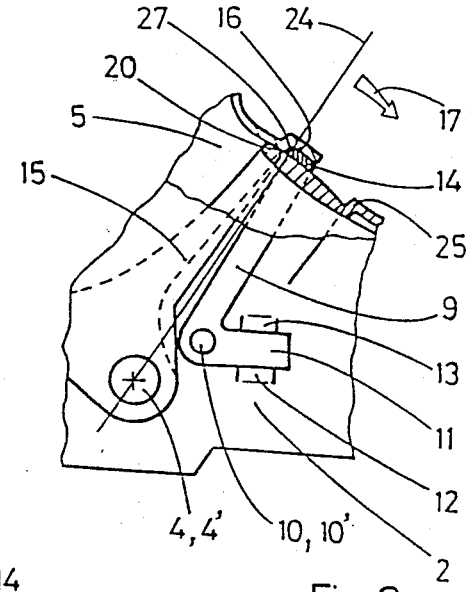
Fig. 2
Fig. 3
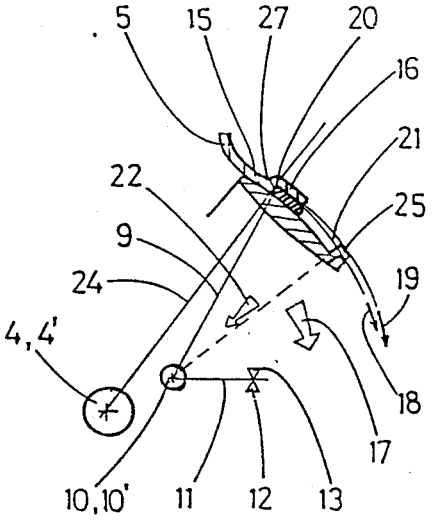
Fig. 4
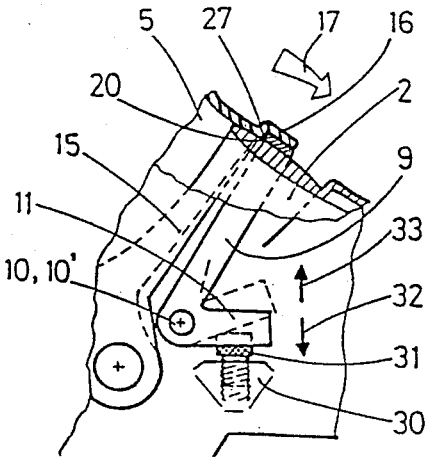

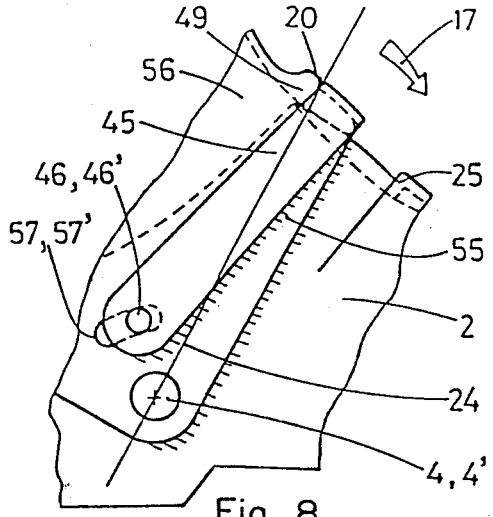
Fig. 8
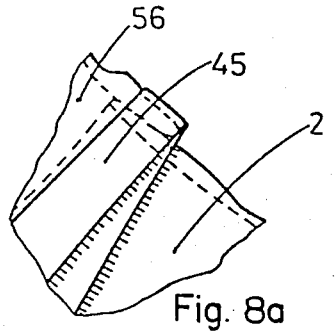
Fig. 8a
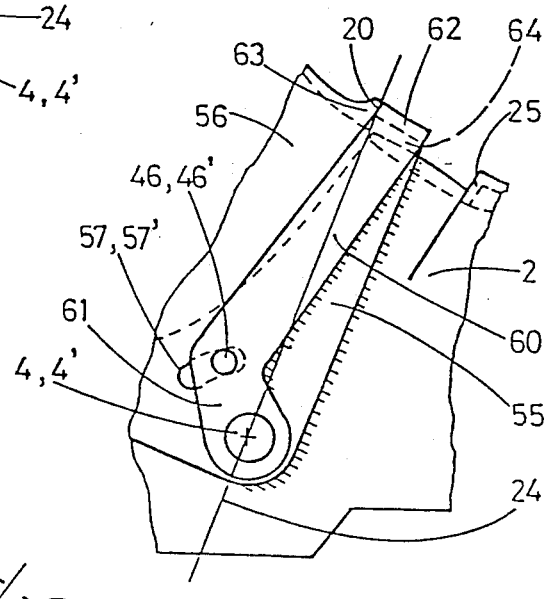
Fig. 9
Fig. 10
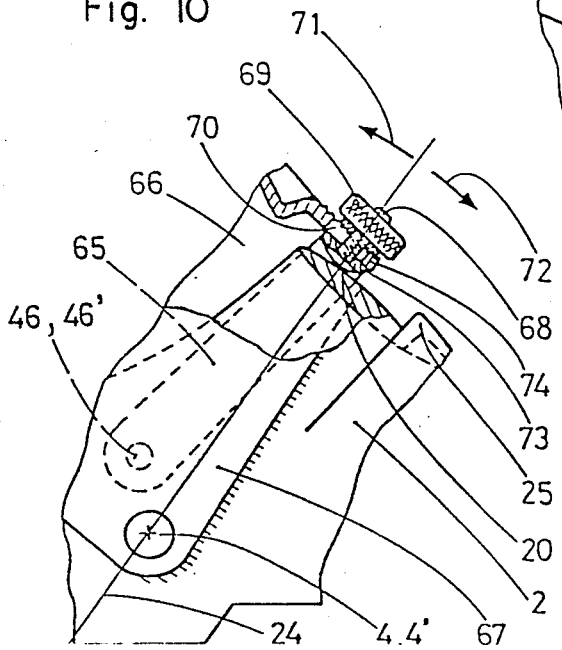

Fig. 15
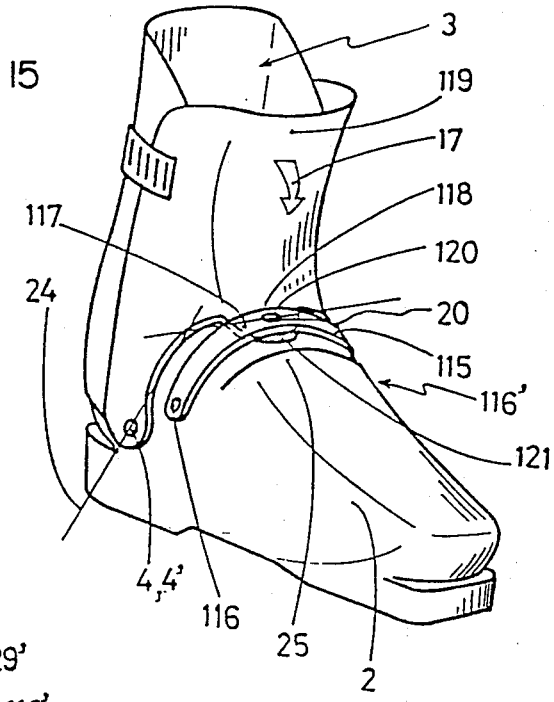
Fig. 16
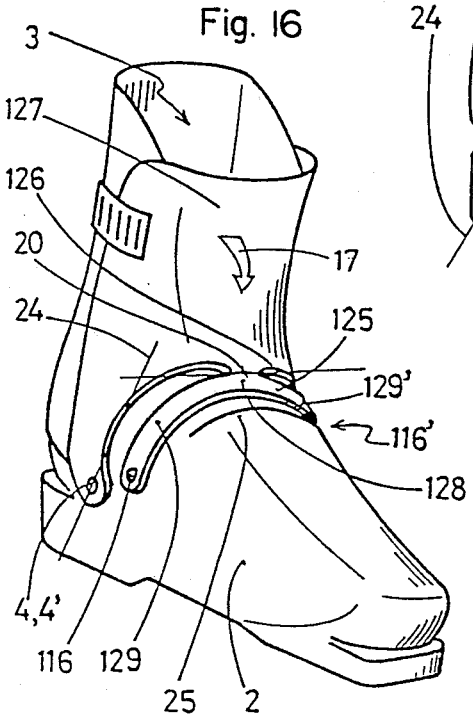
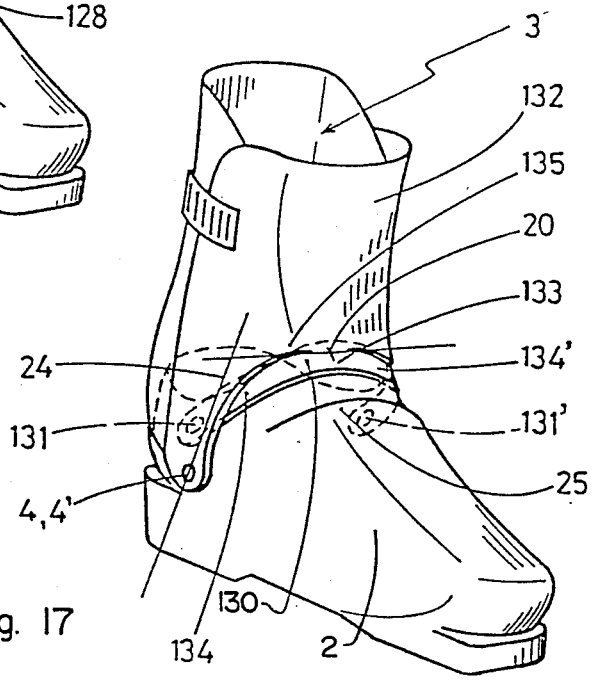
Fig. 17

Fig. 18
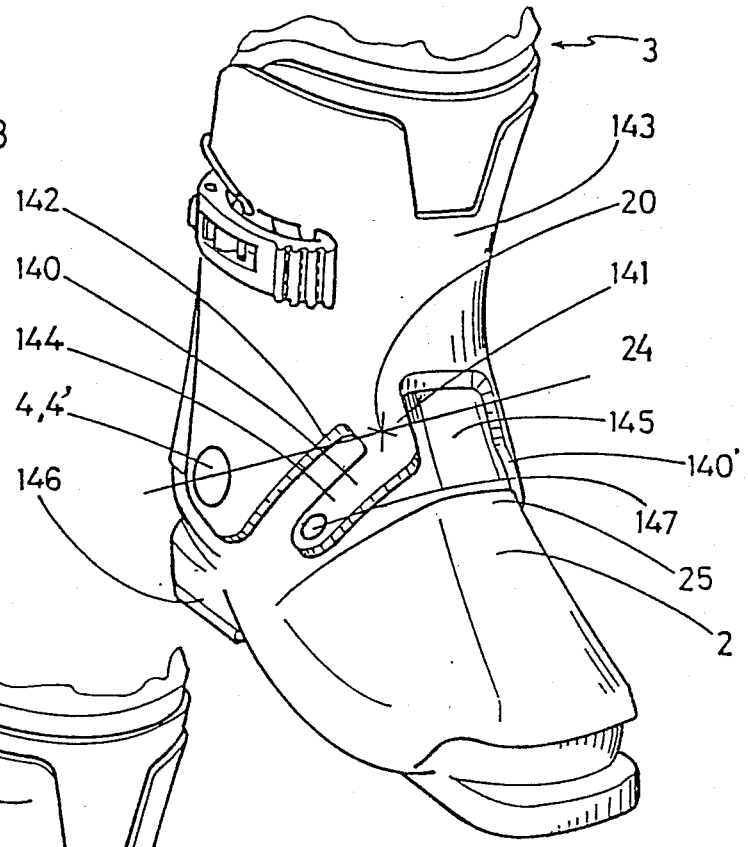
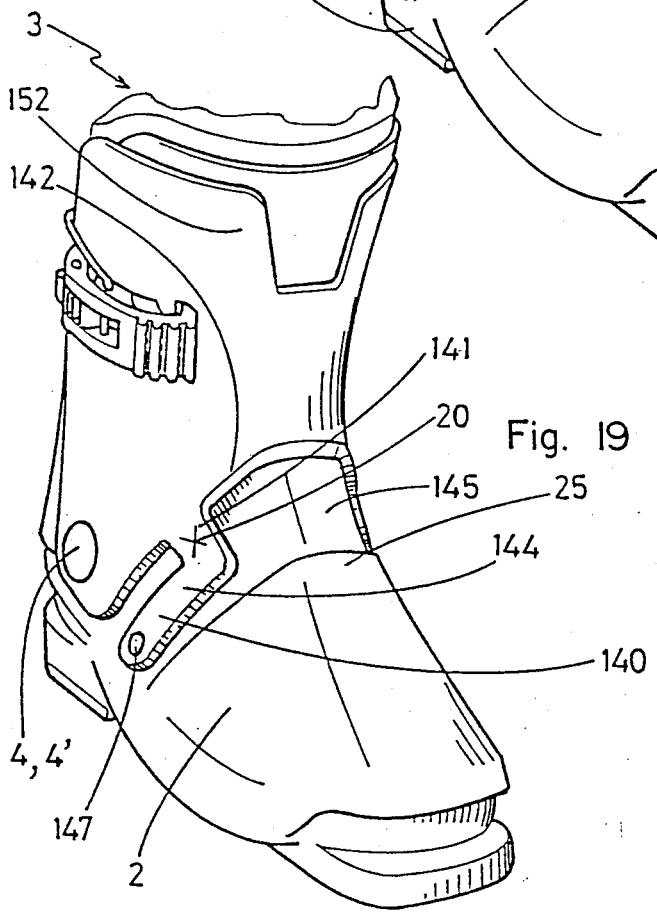
Fig. 19

ALPINE SKI BOOT

This is a division of application Ser. No. 870,374 filed June 4, 1986, now U.S. Pat. No. 4,769,930.

BACKGROUND OF THE INVENTION

1. Field of the Invention

The present invention relates to an alpine ski boot comprising a rigid shell base having a sole, and an upper. The upper is at least partially journalled around a transverse axis on the shell base and its angular position with respect to the transverse axis is controlled by means of an elastic element.

2. Description of Background and Relevant Materials

Different devices have been proposed to assure the optimum maintenance of the foot of the skier in a ski boot, as well as a satisfactory elastic control of the amplitude of displacement of the flexion of the upper of the boot. Satisfactory elastic control of the flexion permits the skier to satisfactorily transmit control forces to the skis.

Thus, for example, French Pat. No. 2 096 248 describes a boot whose flexion of the journalled upper on the shell base is controlled by means of a spring apparatus mounted obliquely between the front of the upper and the top of the shell base in the median axis of the boot. This apparatus acts in the manner of a suspension to generate elastic resistance opposing the frontward inclination (or flexion) of the upper, beginning at a predetermined position of the upper, resting on the shell base. As soon as the flexional forces pivoting the boot frontwardly cease, the apparatus pushes the upper back to its initial position.

According to another apparatus such as is taught in French Pat. No. 2 103 171, the flexion control apparatus is positioned on the lateral portions of the boot and extends between the shell base and the lower front portion of the upper.

In the devices cited above, the flexion control apparatus projects onto the boot by virtue of the use of elastic elements such as compression springs which necessitate the use of a guidance means and a relatively large housing for optimum functioning. Furthermore, the use of such springs is not entirely satisfactory, particularly because they oppose the flexional forces by generating an initial elastic resistance opposing flexion of the boot which is relatively weak compared to the elastic resistance to flexion at the end of the flexion. This provides unsatisfactory control of the skis when the boot is slightly flexed.

Other ski boots have been developed whose flexion control apparatus is integrated into the normal volume encompassed by boot. This type of boot is described in French Patent Application No. 2 484 800. In this boot the elastic element of the flexion control apparatus comprises a flexion control element mounted transversely to the longitudinal axis of the boot. The lower edge of the upper rests against the flexion control element. Further, the ends of the flexion control element are integral with the shell base. In this device the flexion control element operates as a cantilevered beam at its two ends during transverse flexion. This arrangement makes it possible to obtain a relatively high initial elastic resistance when the ski boot is slightly flexed but generates a relatively weak elastic resistance when the upper is at maximum flexion by virtue of the operation and configuration of the flexion element.

Thus, there is a need for a ski boot having a flexion control apparatus which is contained in the normal volume of the boot, and which generates a relatively great elastic resistance at the beginning of the flexion of the upper that increases progressively and moderately as the upper continues to flex forwardly.

SUMMARY OF THE INVENTION

It is an object of the present invention to provide a ski boot and a flexion control apparatus for a ski boot that is contained in the normal volume encompassed by the boot.

It is another object of the present invention to provide a ski boot and flexion control apparatus for the ski boot which generates a relatively great elastic resistance at the beginning of the forward flexion of the boot and which increases progressively and moderately as the upper continues to flex forward.

The invention which achieves these objectives relates to a ski boot comprising a shell base, an upper, and a flexion control means. The upper is adapted to engage the lower leg of a skier and is at least partially journalled on the shell base around a pivot axis so as to permit flexion of the upper with respect to the shell base. The flexion control means is attached to the shell base at a predetermined distance from the pivot axis at a linkage point. The flexion control means abuts the upper at a support point and is so attached to the boot that the flexion control means comprises means: for maintaining a substantially invariant distance from the pivot axis to the support point during forward flexion of the upper; for maintaining a substantially invariant distance from the pivot axis to the linkage point during forward flexion of the upper; and for varying the distance from the support point to the linkage point during forward flexion of the upper.

The shell base comprises a rigid shell base, and the upper comprises a cuff and a rear spoiler. The rear spoiler is adapted to open rearwardly to permit entry of the leg into the boot. As a result, the boot comprises a rear-entry ski boot.

The flexion control means comprises means for generating a force opposing forward flexion of the upper. In addition, the flexion control means is positioned between the shell base and the upper. Further, the boot comprises an instep, and the flexion control means is positioned and extends at least into a portion of the periphery of the instep. Also, the flexion control means comprises at least one elastic element extending substantially transversely to the longitudinal axis of the boot, and the boot further comprises a journal pivotally connecting the upper to the shell base.

The boot further comprises means for linking the at least one elastic element to the shell base at the linkage point. In addition, the at least one elastic element comprises at least one end and the shell base comprises at least one lateral side. The linkage means links the at least one end of the at least one elastic element at least to the at least one lateral side of the shell base at the linkage point.

The cuff comprises a lower peripheral edge so that the support point is positioned at the lower peripheral edge of the cuff, whereby the at least one elastic element abuts the cuff at the lower peripheral edge of the cuff. The boot further comprises means for retaining the elastic element in contact with the lower peripheral edge of the cuff at the support point.

In one embodiment the elastic element comprises two ends (i.e. first and second ends) and the boot further comprises means for linking each end of the elastic element to the shell base. The first end is connected to the shell base by the linkage means and the second end is connected to and is integral with the support point on the lower edge of the cuff. In addition, the at least one elastic element extends transversely and on both sides of the longitudinal axis of the boot. Alternatively, the at least one elastic element extends transversely to the longitudinal axis of the boot on one of the lateral sides of the shell base. In still another embodiment the at least one elastic element extends only on one of the lateral sides of the shell base.

In another embodiment the linkage point is positioned in a zone beneath a plane extending through the pivot axis and the support point. In this embodiment the retaining means can comprise an extension of the lower edge of the cuff for retaining a portion of the at least one elastic element. The extension can further comprise an abutment for retaining the portion of the at least one elastic element. In one embodiment the extension extends over the portion of the at least one elastic element. In an alternative embodiment the portion of the at least one elastic element comprises a median portion of the at least one elastic element. In still another alternative embodiment the retention means comprises a linkage journal for maintaining the position of the portion of the at least one elastic element relative to the cuff. The linkage journal comprises a nut and a bolt, with the bolt extending through the portion of the at least one elastic element. This portion comprises the median portion of the at least one elastic element.

In this embodiment the at least one elastic element can comprise two ends, one end of which is attached to the cuff by the linkage journal and the other end .of which is attached to the shell base. The at least one elastic element can comprise a longitudinally extending slot therein. Further a ring surrounding that portion of the at least one elastic element comprising the slot can be provided. When this ring is provided the position of the ring is adjustable in the longitudinal direction of the at least one elastic element, whereby the elastic resistance of the at least one elastic element is adjusted in response to adjusting the longitudinal position of the ring.

In this embodiment the cuff can comprise an extension positioned under the portion of the at least one elastic element. Also the linkage journal extends through the portion of the at least one elastic element and through the extension.

In still another embodiment the boot further comprises a linkage journal supported on the at least one elastic element linking the at least one elastic element with the lower edge of the cuff. The lower edge of the cuff comprises a cut-out portion abutting the at least one elastic element. In this embodiment the retention means comprises the linkage journal and the cut-out portion the cuff.

In still another embodiment the retention means comprises an extension comprising an integral portion of the lower peripheral edge of the cuff. In this embodiment the extension comprises the at least one elastic element. Also in this embodiment, the extension comprises two elastic element extensions extending in opposite directions transverse to and on either side of the longitudinal median axis of the boot. Each elastic element extension comprises an end, and the boot further comprises two rivets, each of which attaches one of the ends of the elastic element extension to the shell base.

Alternatively, the extension comprises a single elastic element extension extending transversely to the longitudinal axis of the boot only on one side of the median longitudinal axis of the boot. In this embodiment the boot further comprises a sole on the shell base, and the support point is positioned on one of the lateral sides of the shell base in the zone of the instep of the boot. The single elastic extension extends downwardly toward the sole of the boot, and the boot further comprises a journal linking the single elastic element extension with the shell base at the linkage point. In one embodiment the support point is positioned between the instep and the pivot axis. In another embodiment the support point is positioned substantially at the midpoint between the instep and the pivot axis. In addition, the support point can be positioned substantially at the same height as the pivot axis. In this latter embodiment the single elastic element extension can substantially have the shape of an inverted U, open toward the bottom of the shell base.

In still another embodiment the boot comprises an instep, the support point is positioned below the pivot axis, and the single elastic element extension extends from the support point upwardly toward the instep. Alternatively, the support point can be positioned above the pivot axis, and the single elastic element extension can extend from the support point upwardly toward the instep.

In still another embodiment the at least one elastic element is in the shape of a ring comprising two elastic element extensions which extend toward each other and which are attached to the lower peripheral edge of the cuff at different support points.

In still another embodiment the lower edge of the cuff comprises a wall having a predetermined thickness. The wall comprises a cut-out portion formed in the thickness of the wall. The at least one elastic element comprises a portion adapted to engage the cut-out portion of the wall. The portion of the at least one elastic element has a shape complementary to the cut-out portion. In this embodiment the retention means comprises the cut-out portion of the cuff and the complementary portion of the at least one elastic element. In addition, in this embodiment the at least one elastic element comprises a deformable bar comprising first and second ends. The first end comprises the complementary portion and the second end is embedded in the shell base. The bar comprises a deformation zone comprising two opposite longitudinal edges. Each longitudinal edge of the deformation zone has a plurality of notches therein. A portion of the cuff and a portion of the at least one elastic element overlap each other in an overlapping zone. Also, the shell base comprises an element extending into the overlapping zone.

In still another embodiment the linkage point is positioned in a zone above a plane extending through the pivot axis and the support point. In this embodiment the retaining means can comprise an extension of the lower edge of the cuff for retaining a portion of the at least one elastic element. In addition, the extension can further comprise an abutment for retaining the portion of the at least one elastic element. Alternatively, the retention means comprises a linkage journal for maintaining the position of the portion of the at least one elastic element relative to the cuff. In this embodiment the at least one elastic element comprises a longitudinal side, and the abutment comprises a shoulder engaging a portion of this longitudinal side of the at least one elastic element.

The boot can further comprise a linkage journal supported on the at least one elastic element linking the at least one elastic element with the lower edge of the cuff. The lower edge of the cuff comprises a cut-out portion abutting the at least one elastic element. In this embodiment the retention means comprises the linkage journal and the cut-out portion of said cuff.

The retention means can also comprise an extension comprising an integral portion of the lower peripheral edge of the cuff. In this embodiment the extension comprises the at least one elastic element.

In another embodiment the boot further comprises means for embedding the at least one elastic element in the shell base at the linkage point. The embedding means is integral with the shell base.

In another embodiment the boot further comprises at least one journal, integral with the shell base, for connecting the at least one elastic element to the shell base at the linkage point. Alternatively, the boot can comprise two journals for connecting the at least one elastic element to the shell base at two linkage points. In this embodiment the retention means comprises an extension comprising an integral portion of the lower peripheral edge of the cuff. The extension comprises the at least one elastic element, and the extension comprises first, second, and third extensions. The first extension extends from the lower peripheral edge of the cuff and connects the second and third extensions to the cuff. The first extension is positioned substantially in the median longitudinal axis of the boot. The second and third extensions extend symmetrically from the first extension in a zone surrounding the foot, beginning at the instep. The second and third extensions are each connected to the shell base at a linkage point by one of the journals.

Alternatively, the retention means comprises an extension comprising an integral portion of the lower peripheral edge of the cuff. The extension comprises the at least one elastic element and further comprises first and second extensions. The first extension extends from the lower peripheral edge of the cuff. The second extension is attached to the first extension. The first extension connects the second extension to the cuff. The first extension is positioned at any point on the periphery of the skier's foot on the lower edge of the cuff in a zone extending from the instep to the pivot axis.

In one embodiment the second extension extends beyond the first extension generally in a direction downwardly from the first extension. Alternatively, the second extension extends from the first extension and has substantially the shape of an inverted U. The second extension comprises the at least one elastic element, and the linkage point is substantially at the same height as the pivot axis in this embodiment.

In another embodiment the second extension extends beyond the first extension and the second extension has substantially the shape of a reversed L when the boot is viewed from the front toward the rear. The second extension comprises the at least one elastic element and the second extension extends generally upwardly from the first extension.

In one embodiment the at least one elastic element is positioned on one side of the median longitudinal axis of the boot on the shell base. In this embodiment the at least one elastic element comprises a first portion and a second portion. The first portion is positioned on one side of the median longitudinal axis of the boot on the shell base. The second portion is positioned on the other side of the median longitudinal axis of the boot on the shell base. The first portion, furthermore, can have different elastic characteristics than the second portion.

In another embodiment, the at least one elastic element has substantially the shape of a ring integral with the cuff. The substantially ring-shaped at least one elastic element comprises first and second extensions integral with the lower peripheral edge of the cuff. In this embodiment the boot further comprises a journal connecting the at least one elastic element to the shell base. Also, the first and second extensions meet at the journal, and the journal is spaced a predetermined distance from the pivot axis on one of the lateral sides of the shell base. Further, the substantially ring-shaped at least one elastic element extends on each side of the median longitudinal axis of the boot on the shell base.

The invention is also directed to an apparatus for controlling the flexion of the upper of a boot on the shell base of the boot. The boot with which such an apparatus is used can have an upper at least partially journalled on the shell base around a pivot axis so as to permit flexion of the upper with respect to the shell base. The apparatus comprises a flexion control device for controlling the flexion of the upper. The flexion control device is attached to the shell base at a predetermined distance from the pivot axis at a linkage point. The flexion control device abuts the upper at a support point. The flexion control device is so attached to the boot that the device comprises means: for maintaining a substantially invariant distance from the pivot axis to the support point during flexion of the upper; for maintaining a substantially invariant distance from the pivot axis to the linkage point during flexion of the upper; and for varying the distance from the support point to the linkage point during forward flexion of the upper.

The flexion control device comprises means for generating a force opposing forward flexion of the upper. Also, the flexion control device is positioned between the shell base and the upper, and the device extends at least into a portion of the periphery of the instep of the boot. In one embodiment the flexion control device comprises at least one elastic element extending substantially transversely to the longitudinal axis of the boot.

Means for linking the at least one elastic element to the shell base at the linkage point can also be provided. In this embodiment the at least one elastic element comprises at least one end, and the shell base comprises at least one lateral side. The linkage means links the at least one end of the at least one elastic element at least to the at least one lateral side of the shell base at the linkage point.

The upper can comprise a cuff and a spoiler. When this type of boot is used, typically, the spoiler is journalled on the shell base so as to open rearwardly to permit entry of the foot of a skier. Also, the cuff can comprise a lower peripheral edge. When using this type of boot, the support point is positioned at the lower peripheral edge of the cuff, whereby the at least one elastic element abuts the cuff at the lower peripheral edge of the cuff.

Also provided are means for retaining the elastic element in contact with the lower peripheral edge of the cuff at the support point.

BRIEF DESCRIPTION OF THE DRAWINGS

The invention will now be described with reference to the detailed description that follows in conjunction with the attached drawings given by way of non-limiting example only, in which:

FIGS. 1, 2 and 3 are schematic views of a ski boot comprising a flexion control apparatus according to a first embodiment of the present invention;

FIG. 1 illustrates a perspective view of the front portion of the ski boot and shows an embodiment for connecting the elastic element of the flexion control apparatus between the shell base and the cuff of the upper of the boot;

FIG. 2 is a partial cross-sectional view of the boot shown in FIG. 1 along line II—II of FIG. 1 illustrating the details of the operation of the flexion control apparatus;

FIG. 3 is a schematic view of the details of the boot shown in FIG. 2 and highlights the process of elastic control of the flexion, and in particular, the mode of operation of the elastic element;

FIG. 4 is a partial cross-sectional view of an alternative embodiment for the connection of the elastic element on the shell base and more particularly shows a means for adjusting the position of the elastic element with respect to the position of the cuff;

FIGS. 7, 8, 8*a*, 9 and 10 schematically illustrate a third embodiment of the flexion control apparatus of the present invention in which the elastic element generates its elastic resistance when extended and/or when flexed and extended;

FIG. 7 illustrates for example an elastic element which generates its elastic force when extended, the elastic element being positioned under the cuff on the shell base, while its median portion, which cooperates with the lower edge of the cuff, partially covers the cuff so as to be supported thereon;

In FIGS. 8 and 8*a*, which show a small portion of FIG. 8, the elastic element extends onto the lower edge of the cuff and is connected by its ends to the shell base by means of anchorage journals which traverse the wall of the cuff;

In FIG. 9 the elastic element comprises extensions which extend beyond its connection to the shell base in the direction of the journal axis of the upper to which it is integrally connected, the elastic element generating its elastic force as a result during flexion and extension;

In FIG. 10, the elastic element is positioned entirely under the cuff, and a linkage means such as a bolt is provided to assure the retention of the relative position of the elastic element and its support point with respect to the lower median edge of the cuff;

FIGS. 11 and 12 illustrate an embodiment in which one end of the elastic element is supported by a pivotal attachment to the lower edge of the cuff and in which its other end is pivoted on the shell base;

FIG. 13 illustrates another embodiment in which the lower edge of the cuff comprises a cutout in which one end of the elastic element is supported, the other end of the elastic element being connected to the shell base;

FIGS. 15, 16 and 17 illustrate perspective views of a fifth embodiment of the flexion control apparatus of the present invention, in which:

FIG. 15 illustrates one example of a means for retaining the position of the support point of the elastic element on the lower edge of the cuff, wherein this retaining means is a rivet;

FIGS. 16 and 17 illustrate another example of such a retention means which in this embodiment is formed by providing an extension on the lower edge of the cuff which comprises he elastic element itself;

FIGS. 18, 19, and 20 illustrate perspective views of different embodiments of the elastic element in which the support zone of the elastic element on the cuff is formed by an extension of the lower edge of the cuff, this zone being situated above the plane passing through the journal axis of the upper and the linkage point of the elastic element on the shell base;

DESCRIPTION OF PREFERRED EMBODIMENTS

Figure 5:
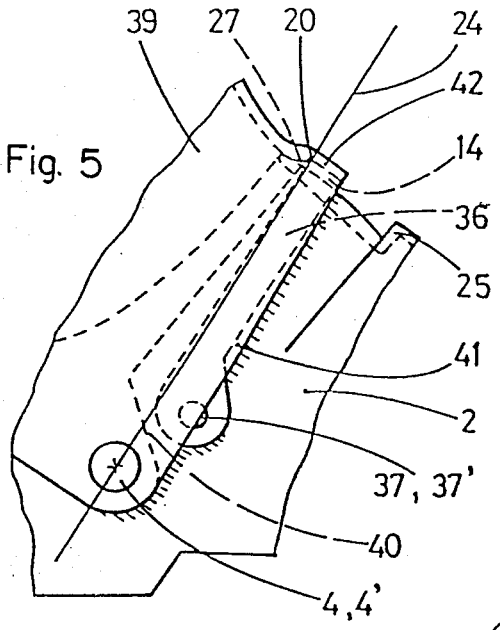
FIGS. 5 and 6 are schematic views of a flexion control apparatus according to a second embodiment of the present invention in which the elastic element produces its elastic resistance essentially during flexion.

The present invention has as an aim to provide a new flexion control apparatus contained in the normal volume encompassed by the ski boot, whose elastic element generates a relatively high initial resistance opposing initial flexion of the boot while allowing for an optimum flexion of the upper with respect to the shell base, and whose elastic element then increases the elastic resistance after the initial flexion in a progressive and moderated manner.

The boot achieving this goal is of the rear-entry type and comprises a rigid shell base on which an upper is mounted. The upper is adapted to house and maintain the lower leg of the skier. The upper comprises a front portion called a cuff and a rear portion called a spoiler, connected to one another by closure means for closing the upper around the lower leg. The upper is at least partially journalled on the shell base at a journal against the bias of control means for controlling the frontward support of the leg of the skier. These control means comprise an elastic element connected to the shell base and extending transversely to the longitudinal axis of the boot, over one portion at least of the periphery of the foot in a zone extending substantially from the flexion fold to the instep of the boot.

According to the invention, one end of the elastic element is connected at least to the shell base at a predetermined distance from the journal of the upper. In addition the elastic element cooperates and engages at a support point with the lower edge of the cuff of the upper. Also provided is means for retaining the position of the support point of the elastic element with the lower edge of the cuff. This retaining means is positioned on the lower edge of the cuff at the support point. As a result of such an arrangement, the trajectory of the support point of the elastic element during forward flexion of the upper corresponds to and is the same as the trajectory of the lower edge of the cuff of the upper with which it cooperates, despite the extension of the connection of the elastic element with respect to the journal axis of the upper on the shell base. As a result, the difference in trajectories of the support point and the lower edge of the cuff which would normally exist between the support point of the elastic element and the lower edge of the cuff, from the initial position of the upper to its most flexed position on the front of the boot, is absorbed by a corresponding deformation of the elastic element.

According to a first embodiment of the invention, the elastic element extends on both sides of the instep of the boot so that it partially covers the instep. Further, the ends of the elastic element are each embedded on one lateral portion of the shell base, beneath the plane passing through the journal axis of the upper and through the support point of the elastic element on the lower edge of the cuff. In addition, the median portion of the elastic element, substantially in the median longitudinal axis of the boot, cooperates with and engages through a support zone, centered on the longitudinal axis, the lower edge of the cuff. A covering tongue formed on the cuff caps the support zone.

As previously explained, the connection of the elastic element to the shell base, and more precisely the embedding of the elastic element in the shell base occurs at a linkage point, a certain distance from the journal axis of the upper on the boot. Further, the elastic element is linked at its support point to the cuff. As a result, rather than pivoting around its linkage point, the support point of the elastic element follows a different , trajectory, called an induced trajectory, which is different from the trajectory of other portions of the elastic element, such as those portions near the linkage point at which the elastic element is embedded in the shell base. Thus, during frontward flexional movement of the upper caused by forward pressure from the leg of the skier, the upper flexes towards the shell base, against the resistance of the elastic element which, retained prisoner under the covering tongue of the lower edge of the cuff, is constrained to deform while flexing between its support zone and its ends which are embedded in the shell base in the longitudinal and transverse direction from the support zone. In this embodiment the flexional limit of the upper beyond which the upper cannot flex forward is determined by an edge formed on the shell base. This edge substantially corresponds to the median portion of the elastic element and engages and abuts the median portion of the elastic element.

According to another embodiment, the edge formed on the shell base serves as an abutment to prevent frontward flexion beyond a certain limit not by direct contact with the elastic element, but by engaging the covering tongue provided on the lower edge of the cuff. Alternatively, the elastic element can be partially or totally covered by the lower edge of the cuff, a sufficient play being then provided between the elastic element and the shell base so as to allow for the deformation of the elastic element.

In a second embodiment of the invention the elastic element is positioned as in the first embodiment described above, but its ends are pivotably mounted on the shell base. In this embodiment, the operation of the boot is identical to the first embodiment except that the mode of operation of the elastic element varies to the extent that the constraints compressing the elastic element are exerted in the longitudinal direction of the elastic element.

A third embodiment comprises an elastic element which becomes extended so as to generate its elastic force. In this embodiment the ends of the elastic element are connected to the shell base at a position located transversely to the longitudinal axis of the boot in the zone of the instep above the plane passing through the journal axis of the upper and through the support point of the upper with the elastic element. In one embodiment, the elastic element has its ends covered under the lateral edges of the cuff, while only its median portion is positioned above a support tongue formed on the lower median edge of the cuff. To allow for the positioning of the elastic element, passage slots are provided in the wall of the cuff on both sides of the support tongue.

According to a fourth embodiment, the elastic element extends totally above the lower edge of the cuff. Its ends are connected to the shell base by means of linkage journals integral therewith which traverse the cuff. The cuff is provided with corresponding oblong passage slots substantially in the shape of beans which extend concentrically to the journal axis. During frontward flexion of the upper, the cuff pivots on its journal axis, without being constrained by the linkage journals linking the cuff to the the elastic element against the elastic element, due to the use of the bean shaped slots. The elastic apparatus comprises an extension between the median portion of the cuff and its linkage journal. Passage slots for the linkage journals are provided so as to allow for the flexion of the upper, but these slots can be voluntarily limited in their ability to open so as to serve as abutments for the cuff during extreme flexion and/or during a rear support position of the boot.

In a fifth embodiment, the elastic element is mounted in a manner identical to the preceeding embodiments but in this embodiment the elastic element comprises an extension which extends beyond its journals retaining the elastic element on the shell base in the direction of the journal axis of the upper. Further, this extension is integral with the journal of the upper. As a result of this structure, the elastic element is both extended and flexed during forward flexion of the upper.

According to yet another embodiment, in which the elastic element is extended so as to generate its elastic force, the elastic element is entirely covered by the lower edge of the cuff, and its connection to the shell base is pivotably achieved by means of a journal integral with the shell base. The median portion of the elastic element, itself, is connected to the cuff by means of a flat-headed screw in the middle and under the lower edge of the cuff. A milled screwnut mounted on the screw assures the assembly of these two elements. In this embodiment, one can preferably provide an oblong slot in the median portion of the lower edge of the cuff, for the passage of the threaded screw of the upper, which makes it possible to adjust the position of the elastic element With respect to the cuff and/or to substantially modify the tension of the elastic element.

In another embodiment, of the present invention, the elastic element is positioned laterally at least on one of the sides of the shell base in the zone corresponding to the lateral zone of the instep. According to one particular variation of this embodiment, the elastic element is pivotally connected at its two ends to the shell base and the cuff, respectively. One of the ends of the elastic element is provided with an engaging means comprising the support point with a lower edge of the cuff, while the other end comprises a linkage journal engaging the shell base. This linkage journal is positioned, in this embodiment, beneath the plane passing through the journal axis of the cuff and through the support point on the lower edge of the cuff. This embodiment need not be limited to cylindrical linkage journals; it is within the scope of the invention to use linkage means with the shell base, which are different, such as for example mechanical assemblages which are known in and of themselves, such as riveting, welding, embedding, etc.

In a similar manner to that which has been explained for the preceeding embodiments, the means of engaging the elastic element with the cuff at the support point is fixed to the cuff so that the trajectory of the support point corresponds to the trajectory of the lower edge of the cuff. Of course, the elastic element can be at least partially covered by the lower edge of the cuff or extend above it. In this type of construction, it is advantageous to position an elastic element on each side of the boot either symmetrically or unsymmetrically.

As was explained in the various preceeding embodiments, the means for engaging the elastic element and the cuff can be situated: in the zone of the instep, substantially in the longitudinal median axis of the boot, or in the lateral zone of the instep on at least one of the lateral sides of the boot. Without going beyond the scope of the invention, these engaging means can preferably be, depending upon the type of construction of the boot, made either disassemblable so as to allow, for example, for the interchangeability of elastic elements, or not capable of disassembly, in which case for example, they can simply be an integral portion of the cuff.

Another embodiment of the flexion control apparatus of the present invention comprises an elastic element integral with the lower edge of the cuff. The end of the elastic element engages the lower edge of the cuff by means of a rivet, for example, with the rivet comprising the support point of the elastic element and the cuff.

It is evident that the shape of the elastic element can have a variety of shapes as a function of the elastic resistance which it must generate to oppose the frontward flexional forces the skier exerts on the upper and also as a function of the material of which it is composed. Thus, for example, the elastic element can have the form of a crescent, one end of which is integral with the lower edge of the cuff, while the other end of which is connected to the shell base in the zone extending between the instep and the sole.

Of course, depending upon the flexional control which is desired, one can preferably provide two elastic elements positioned respectively on each side of the longitudinal median axis of the boot on the shell base. Furthermore, each elastic element on different sides of the longitudinal median axis of the boot can have different elastic and deformation characteristics and/or shapes.

According to one embodiment of the boot according to the invention, which is different in its construction from previous embodiments, the portion of the shell base which surrounds the foot in the zone of the instep and which is capped by the lower edge of the cuff and/or by the elastic element can preferably be provided with a surface of sliding and joining or comprise an opening adapted to receive a sliding and/or joining element. This element can be retained on the shell base by any means such as gluing, riveting, nesting, etc. Furthermore, the elastic element can be provided with an adjustment means for adjusting its elastic characteristics. Finally, the angular position of upper of the boot with respect to the shell base in the longitudinal direction of the boot can be adapted to be adjusted. This can be accomplished by any known means such as by means acting in the zone of the heel between the shell base and the rear portion of the upper. Further, it may be useful to provide for the elastic element itself to be adjustable so as to adjust its angular position with respect to the lower edge of the cuff. To accomplish this, in the case where the elastic element is connected pivotally on the shell base, an extension or a point of activation can be provided on the elastic element, preferably in the vicinity of its pivot axis. This extension is adapted to cooperate with an abutment such as a screw whose position is adjustable on the shell base. Of course, when the elastic element is embedded in the boot, the angular position with which it is embedding can also be adjusted on the shell base.

It is also within the scope of the invention to change the position of the connection of the elastic element on the shell base, at a distance from the journal axis of the cuff, by means of a journal or the embedding of the elastic element at a different position. For example, this means can comprise a plurality of openings or notches or the like which permit to change from one position to one another and which are adapted to modify the angle of action of the elastic element, thus modifying resulting forces with respect to the upper.

The invention will now be discussed with reference to the various embodiments illustrated in FIGS. 1–23. In these figures when the same reference numeral is used in different figures, these identical reference numerals refer to same element.

FIGS. 1 and 2 illustrate an apparatus for flexion control adapted for use with a ski boot 1. Ski boot 1 comprises a shell base 2 on which is mounted an upper 3 journalled on the shell base around a transverse axis 4, 4'. Reference numerals 4, 4' also refer to transverse journals 4, 4' on which upper 3 is journalled on shell base 2. The upper comprises a front portion 5, hereinafter referred to as a cuff, and a rear portion 6 hereinafter referred to as a spoiler. The spoiler is adapted to pivot in the rearward direction along the direction of arrow 7 so as to allow for the introduction of the foot into the boot. Also, spoiler 6 can be latched on cuff 5 by known closure means such as a buckle 8 so as to assure the closure and tightening of the upper on the lower leg of the skier. In the embodiment shown in FIGS. 1–2, spoiler 6 is journalled on shell base 2 on the same axis 4, 4' as cuff 5.

Cuff 5 is maintained elastically in a frontwardly flexed position with respect to shell base 2 by means of a flexion control device comprising an elastic element 9 which extends on both sides of the instep of the boot.

It should be noted that as used in this application that portion of the boot which flexes and folds on itself during forward flexion is called the flexion fold or flexion zone of the boot.

Elastic element 9 is in the form of a stirrup. Elastic element 9 engages a lower edge 15 of cuff 5 at a support point 20. The ends of elastic element 9 are connected to shell base 2 by rivets 10, 10' beneath a plane 24 passing through journal axis 4, 4' and through support point 20 of the elastic element 9 on the lower edge 15 of the cuff 5. At least one of the ends of elastic element 9 comprises an extension 11 which is immobilized on the shell base by being embedded between projections 12 and 13 on shell base 2. A median portion 14 of elastic element 9 comprises a long, narrow surface which engages an abutment 27 positioned on the lower front edge of cuff 5 at support point 20, which is substantially situated at the apex of the zone of the instep. An extension 16 is provided on edge 15 of cuff 5 at the location of the support point. Extension 16 serves as a retention element and an abutment for retaining median portion 14 of elastic element 9 on lower edge 15 of cuff 5. Extension 16 requires median portion 14 of elastic element 9 to follow the same trajectory 18 as its support point 20 on edge 15 on cuff 5 when the cuff is flexed forwardly along the direction of arrow 17 (as seen in FIGS. 2 and 3) around its journal 4, 4'. As shown schematically in FIG. 3 elastic element 9 tends, under the effect of flexional force, to pivot around rivets 10 and 10' (which comprise means for linking elastic element 9 with shell base 2) on the shell base 2, thereby following a trajectory 19 directed toward trajectory 18 of the support point 20, which pivots around the axis 4, 4' of the cuff. This difference in the trajectories at point 21 causes, for a flexional displacement of cuff 5 in the direction of arrow 17, a corresponding compression of elastic element 9 in the direction of arrow 22. Compression of elastic element 9 in the direction of arrow 22, in turn, generates a force opposing the longitudinal forward flexion of cuff 5. This force resulting from the compressing of elastic element 9 in the direction of arrow 22 is added to another force generated by elastic element 9: the force opposing transverse flexion results from compression of extension 11 between points 12 and 13 in a direction transverse to the longitudinal axis of elastic elements. Also in this embodiment, preferably a projection 25 is formed on shell base 2 in the zone of the instep to serve as a positive abutment for cuff 5 so as to prevent the amplitude of flexional movement 17 from exceeding a predetermined value beyond which it would be dangerous to the skier.

According to an alternative embodiment illustrated in FIG. 4, extension 11 of elastic element 9 is not retained abutting on shell base 2 except in the direction of arrow 17. In this embodiment shell base 2 comprises a projection 30 provided with an abutment 31 which is vertically adjustable in the direction of arrows 32 and/or 33. Thus, depending upon the initial position of inclination of the upper of the boot and thus of cuff 5, elastic element 9 will still follow lower edge 15 and support 20.

Figure 6:
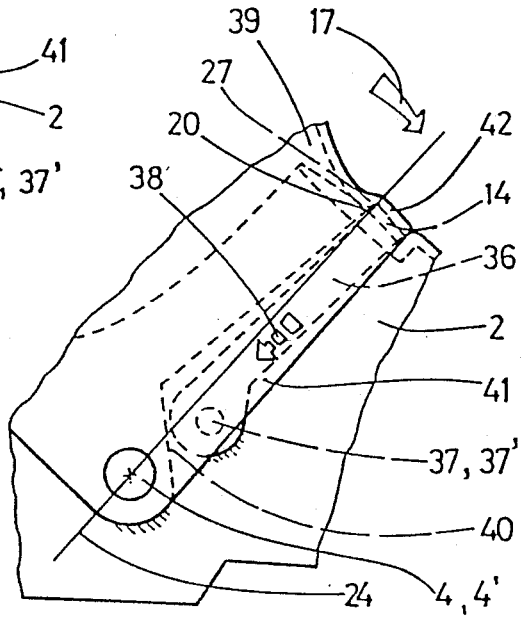

FIGS. 5 and 6 illustrate a second embodiment in which an elastic element 36 is pivotably mounted on shell base 2 around journals 37 and 37' situated beneath plane 24 passing through journals 4, 4' and through support point 20 under retention edge 42 of lower edge 41 of cuff 39. In this embodiment, elastic element 36 is compressed only in the longitudinal direction of elastic apparatus 9 in the direction of arrow 38 during frontward flexional movement of cuff 39 indicated by arrow 17. Preferably, cuff 39 is provided with an opening 40 extending under lower edge 41 into which elastic element 36 is introduced and positioned.

According to another embodiment illustrated in FIGS. 7, 8, 9 and 10, an elastic element 45 is journalled or partially journalled on the shell base in the zone extending above a plane 24 passing through journal axis 4, 4' of the upper of the boot and through support point 20 of the elastic element on the lower edge of the cuff. Such an arrangement of the elastic element causes a modification of the respective trajectories of the support point 20 and of the corresponding cooperating portion of the elastic element.

Figure 7:
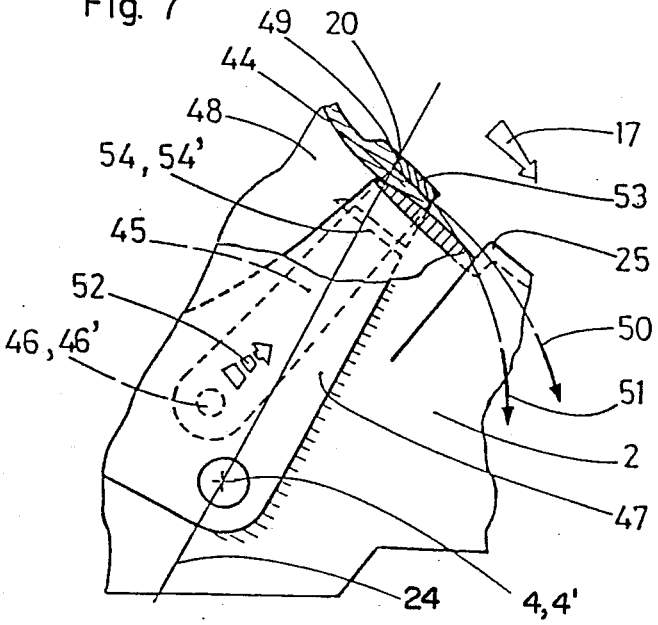

In the embodiment shown in FIG. 7, an elastic element 45 is in the form of a stirrup whose ends are connected in a pivotable manner on shell base 2 by means of journals 46 and 46'. These journals are positioned above plane 24 and only the median portion of the stirrup partially covers an extension 44 of lower edge 47 of cuff 48 in the zone of the instep. Slots 54 and 54' are provided on both sides of the zone of the instep of the boot to allow for the passage of stirrup 45 across the sides of cuff 48, while a shoulder 49, provided on the lower edge 47 of the cuff, serves as a retention abutment comprising support 20. When cuff 48 is flexed to the front of the boot, in the direction of arrow 17, its lower edge 47 requires that median portion 53 of elastic element 45 follow trajectory 50 by pivoting around axis 4 and 4' which describes an arc greater than arc 51 of the elastic element 45 around its axes 46 and 46'. This difference in the trajectories thus causes a corresponding elastic deformation of elastic element 45 which undergoes a stretching or an extension in the direction of arrow 52 in the longitudinal direction of element 45, which elastically opposes flexional movement of the upper in the direction of arrow 17.

In FIGS. 8 and 8*a*, elastic element 45 is positioned on shell base 2 in the same manner as in FIG. 7, except that it totally overlaps lower edge 55 of cuff 56. The lateral walls of cuff 56 comprise for this purpose passage openings or slots 57 and 57' for journals 46 and 46' which link elastic element 45 on shell base 2 (journals 46 and 46' are called linkage journals). In order to permit cuff 56 to flex forward in the direction of arrow 17 around journals 4 and 4', passage slots 57 and 57', having a configuration which is concentric to axes 4 and 4', extend on both sides of axes 46 and 46' along an angular sector corresponding to an angular displacement of cuff 56.

FIG. 9 shows another embodiment of the flexion control apparatus comparable to that illustrated in FIG. 8. In this embodiment, elastic element 60 is pivotably retained around its journals 46 and 46' by means of an extension 61 extending downwardly to journals 4 and 4' on which cuff 56 is journalled on the shell base. In this embodiment, when cuff 56 is flexionally displaced in the direction of the front of the boot along the direction of arrow 17 elastic element 60 generates a resistance due to the combined flexing and extension of elastic element 60 which opposes forward flexion of the cuff. This can be seen as follows. During frontward flexion cuff 56 pivots frontwardly around axis 4 and 4' and causes similar pivoting of median portion 62 of elastic element 60 with which it engages. More specifically median portion 62 of elastic element 60 engages shoulder 63 of cuff 56 and an extension 64 of lower edge 55 of cuff 56. Oblong slots 57 and 57' provided in the lateral walls of the cuff and which extend concentrically to axes 4 and 4' allow a certain angular displacement of cuff 56 towards the front with respect to linkage pivots 46 and 46' of the elastic element 60 with the shell base. For a given angular displacement of the cuff, elastic element 60 undergoes a predetermined flexion in a zone which may, according to FIG. 9, correspond to that situated between axes 4 and 4' and pivots 46 and 46'. The limit of the angular displacement of the cuff is achieved, for example, when pivot 46 abuts on one end of slot 57. When this limit is reached, elastic element 60 is then deformed in such a manner as to extend element 60 according to the process described with respect to FIG. 8. It will be noted that flexion abutment 25, illustrated in FIG. 9 and provided on the shell base is not obligatory by virtue of the fact that linkage pivots 46 and 46' can comprise, in this embodiment, flexion abutments.

According to the embodiment illustrated in FIG. 10, the flexion control apparatus shown is similar to that illustrated in FIGS. 7, 8 and 9, except that elastic element 65 is connected to shell base 2 by linkage pivots 46 and 46' in a zone situated above the plane passing through journal axis 4 and 4' of cuff 66 passing through the support point 20 of median portion 73 of the elastic element on the lower edge 67 of the cuff. However, the retention of elastic element 65 in support position 20 on lower edge 67 of the cuff is accomplished, in this embodiment, by means of an assembly 68–69 of the nut and bolt type. The assembly comprises a bolt 68 having a threaded shaft extending through the thickness of median portion 73 of elastic element 65 and through abutment 74 of the lower edge 67, thus making it possible for them to maintain their assembled position. An improvement in this embodiment can be made by providing an oblong slot for the passage of the threaded shaft 68, which makes it possible to adjust the initial angular position in the direction of arrows 71 and/or 72 of flexion element 65 and/or its tension with respect to the position of cuff 66.

Figure 11:
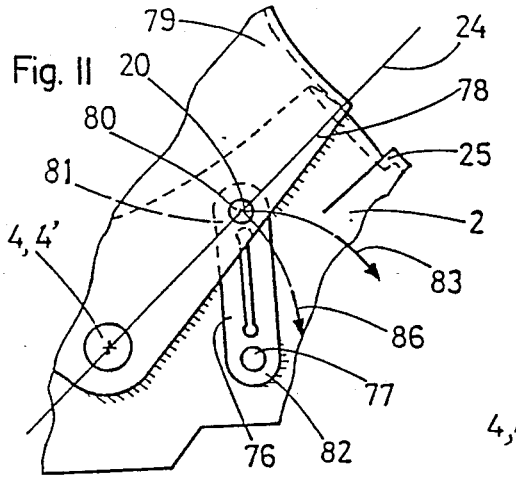
FIGS. 11, 12 and 13 illustrate schematic views of a fourth embodiment of the flexion control apparatus of the present invention in which the elastic element extends between the shell base and the cuff in a zone included between the longitudinal median axis of the boot beginning at the instep and the journal axis of the upper.
Figure 12:
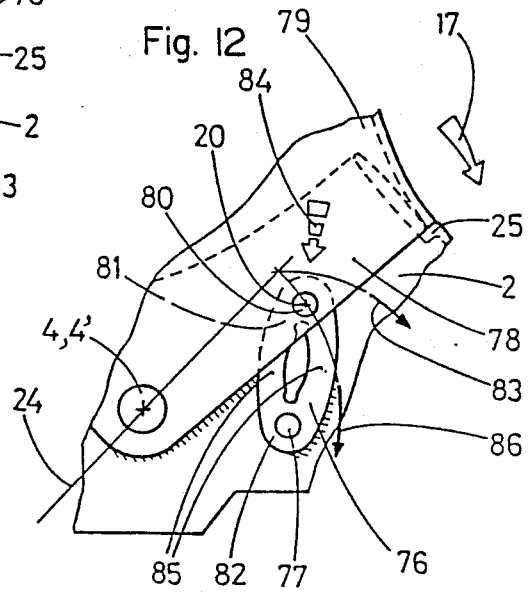
Figure 13:
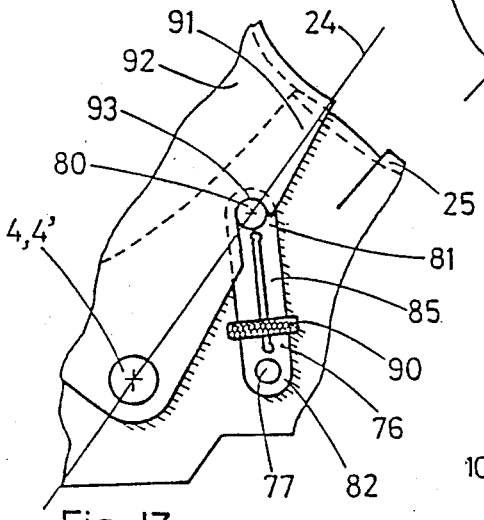

The embodiments illustrated in FIGS. 11–13 use a structure or support point of the cuff with the elastic element which is no longer positioned at the median portion of the cuff, but rather is positioned laterally on either side of the median longitudinal axis of the boot. The description which follows is applicable as well to the use of two elastic elements on two sides of the boot even though for simplicity only one side is referred to.

Thus, in FIGS. 11 and 12 the flexion control apparatus comprises an elastic element 76 extending laterally to the shell base along a substantially vertical direction with respect to the plane of the sole of the boot. The arrangement of this elastic element defines a triangular system having three sides defined by: the distance between journal axis 4 and 4' of the cuff on the shell base and anchorage pivot 77 of the elastic element on the shell base; by the length of element 76 itself; and by that portion of lower edge 78 of cuff 79 defined by the distance between journal axis 4 and 4' and linkage pivot 80 pivotally linking elastic element 76 to cuff 79. Pivot 80 serves the role of support point 20 situated approximately at mid-length between the journal axis 4 and 4' and the apex of the lower edge of the cuff. Of course this positioning of support point 20 is not limited to the mid-length position defined above. It is within the scope of the present invention to provide a different position for support point 20, and even to provide means for adjusting the position of support 20 along the length of the lower edge of the cuff.

In this embodiment, ends 81 of the elastic element, which engage lower edge 78 of the cuff, are partially engaged under edge 78, but can, conversely, partially cover the cuff. As in previous embodiments, during frontward flexion of the cuff in the direction of arrow 17, the retention of elastic element 76 with the cuff 79 by means of linkage pivot 80 at the location of support point 20 causes the elastic element to follow a trajectory 86 which is concentric to journal axis 4 and 4' of the cuff in opposition to its theoretical trajectory 83 concentric to linkage pivot 77 which pivotally attaches elastic element 76 to the shell base. This difference in trajectories as illustrated in FIG. 12, causes a coming together in the direction of arrow 84 of linkage pivots 77 and 80 at the ends 81 and 82 of elastic element 76. As a result, elastic element 76 is deformed in its median zone 85, thereby generating a certain resistance which opposes forward flexion of the cuff and defines the value of the flexion control.

This elastic resistance of elastic element 76 can preferably be adjustable, as illustrated in FIG. 13. In this embodiment, elastic element 76 is provided with a ring 90 which surrounds median portion 85 of element 76. The ring is displaceable along the length of the median portion to modify the active deformable length of elastic element, thereby modifying its resistance force.

According to an alternative embodiment, the retention of end 81 of the elastic element against a lower edge 91 of cuff 92 is accomplished by a cutout 93 which engages and presses against pivot 80 extending from elastic element 76 (also shown in FIG. 13). This cut-out portion has a shape complementary to pivot 80 and end 81. Such a system permits one to disconnect or to make the flexion control apparatus detachable from the upper of the boot so that the boot can be placed in a "non-ski" position to facilitate walking because in the "non-ski" position the amplitude of flexion of the upper is increased to the amount necessary for a walking gait.

Figure 14:
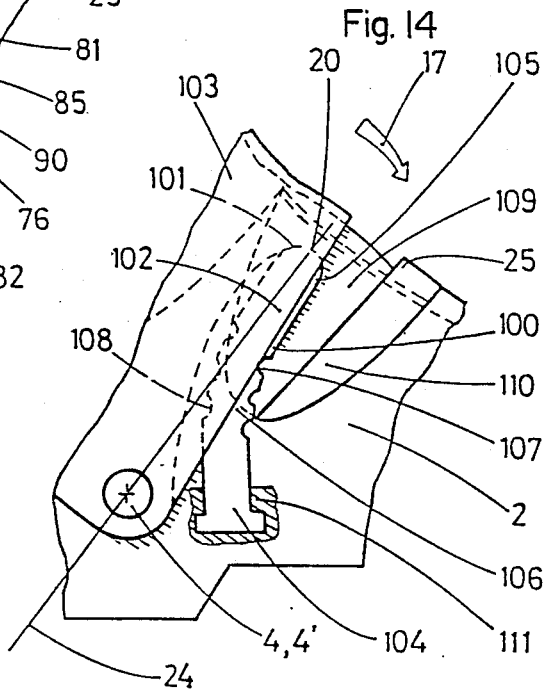
FIG. 14 illustrates a schematic view of one example of the connection between the elastic element and the boot by embedding the elastic element on the shell base and by the use of a friction element in the overlapping zone of the cuff on the shell base.

In FIG. 14, elastic element 100 extends on the side of shell base 2 and its support 20 comprises a cutout 101 provided in the thickness of the wall of the lower edge 102 of cuff 103. Elastic element 100 is in the form of an elastically deformable bar having one end 104 embedded in an opening 111 on the shell base, and having its other end 105 abutting cutout 101. Similar to the preceding embodiments, this bar defines a deformable triangular system on the lateral zone or zones of the boot.

Figure 14A:
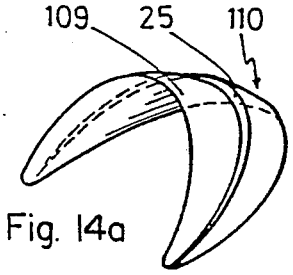
FIG. 14*a* is a perspective view of the friction element shown in FIG. 14.
Figure 21:
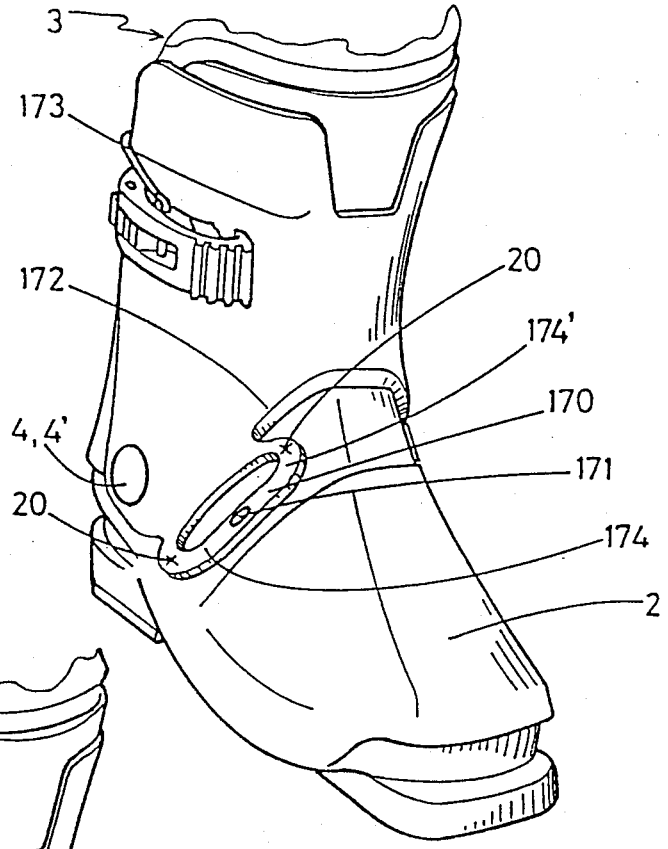
FIG. 21 illustrates a perspective view of a particular embodiment of the elastic element which, formed by two extensions of the lower edge of the cuff, is in the shape of a ring with two support zones positioned respectively on both sides of the plane passing through the journal axis of the upper and its linkage or connection to the shell base.
Figure 20:
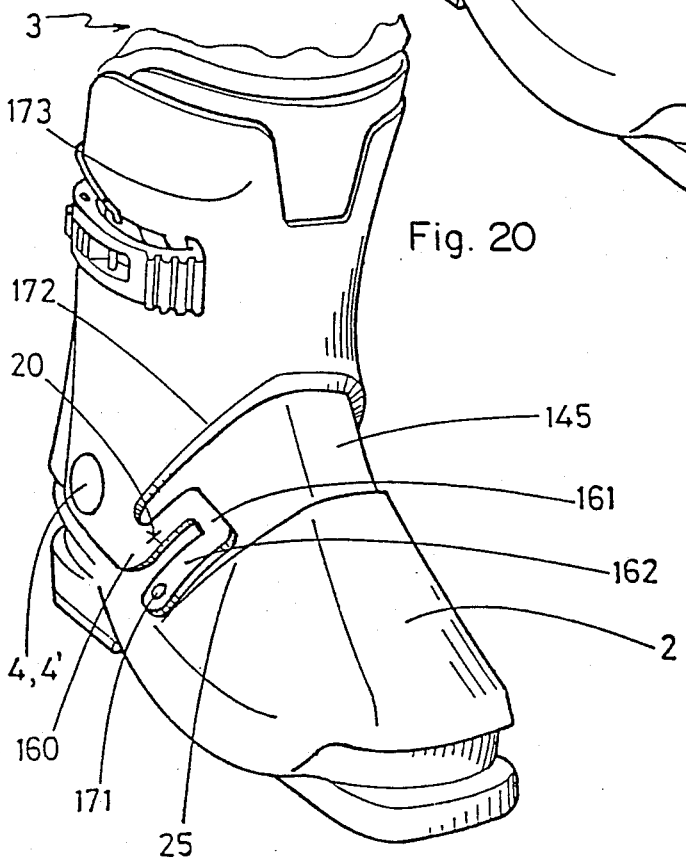

Other known assembly means for attaching the bar to the base are within the scope of the invention to assure that the bar is embedded and linked to the shell base. Elastic element 100 further comprises one deformation zone 106 having notches 107 and 108 on either side of the bar on the median portion of the elastic element. As a result, during frontward flexion of the cuff in the direction of arrow 17 notches 107 provided on one side of bar 106 come together while notches 108 on the other side are spread apart. It should be understood that overlapping zone between cuff 103 and shell base 2 can be realized with an intermediate additional sliding piece 110 which extends on said shell 2 over entire overlapping zone. In that case the sliding surface 109 of piece 110, on which slides the lower edge 102 of cuff 103, has preferably conjugated complementary shaped to said lower edge 102. (See FIG. 14*a*). This type of construction is particularly advantageous because it optimizes the frictional and adjustment conditions in the overlap zone.

The embodiments illustrated in FIGS. 11, 12, 13 and 14 relate to elastic elements 76 and 100 whose support 77 and/or embedded portion 104 on shell base 2 is positioned beneath the plane 24 passing through the journal axis 4, 4' of cuff 92 and 103, and support point 20. It is understood of course as described previously with reference to FIGS. 7–10, that elastic elements 76, 100 can conversely be connected and/or be supported on shell base 2 in the zone extending above plane 24, thereby causing elastic elements 76, 100 to be able to deform by being extended and/or by being flexed and extended.

According to another embodiment of the invention, shown in FIGS. 15–17, the flexion control apparatus is integral with the cuff. Further, the flexion control apparatus can be an integral portion of the cuff, or it can be non-integral with the cuff. Thus, as seen in FIG. 15, elastic element 115 is in the form of a stirrup which extends on both sides of the median longitudinal axis of the boot and on both sides of the zone of the instep on shell base 2. Elastic element 115 is connected at its ends to base 2 by means of journals 116, 116'. Median portion 117 of elastic element 115 engages an extension 121 of the front lower edge 118 of the cuff 119 so that portion 117 covers extension 121, and is connected to extension 121 by means of an assembly rivet 120 which comprises means for retaining support point 20 on the elastic element.

FIG. 16 illustrates an alternative embodiment of FIG. 15 in which the elastic element and the cuff comprise a connection zone 128 or extension connecting and rendering elastic element 125 and cuff 127 integral with one another with space 126 between the cuff and the elastic element. Elastic element 125 extends transversely to the longitudinal axis of the boot substantially along the periphery of the zone of the instep and on both sides of the median longitudinal axis of the boot. Two rivets 116, 116' connect the ends of portions 129, 129' with the lateral walls of the shell base.

The two embodiments of the flexion control apparatus which have just been discussed with reference to FIGS. 15 and 16 illustrate elastic elements 115 and 125 which are attached to shell base 2 in the zone extending beneath the plane 24 which passes through journal axis 4, 4' of the cuff and through the support point 20. This arrangement causes, in the event of frontward flexion of the cuff in the direction of arrow 17, support point 20 to follow a trajectory which is concentric to journal axis 4, 4'. This trajectory of support point 20 approaches journals 116, 116' as the distance of the support axis with respect to the support point 20 is reduced, which causes the deformation of the elastic element 115, 125.

In the embodiment illustrated in FIG. 17, elastic element 130 comprises two extensions 134, 134' which are positioned and extend transversely to an extension 133 of the lower front edge 135 of cuff 132. Support point 20 is positioned on extension 133. The attachment of extensions 134, 134' on shell base 2 is accomplished by means of linkage pivots 131, 131' positioned in the zone extending above the plane 24 which passes through journal axis 4, 4' of cuff 132 and through support point 20. As a result, support point 20, which is fixed to pivot around journal axis 4, 4', has a larger trajectory than that which it would execute if it pivoted around linkage pivots 131, 131' (its normal trajectory); consequently elastic element 30 is deformed, as are its extensions 134 and 134' which are stretched and extended as a result of the deformation.

In the embodiment illustrated in FIG. 18–FIG. 23, the elastic element is still made of one piece with the cuff, as in FIGS. 16 and 17; however, in these embodiments the elastic element extends only on one and/or the other of the lateral sides of shell base 2 and has only one extension beyond support point 20. In addition, it should be noted that in the embodiments of FIGS. 18–23, and the other embodiments discussed above, the elastic element can have different elastic characteristics on different portions of the elastic element, particularly on different sides of the median longitudinal axis of the boot.

In FIG. 18, elastic element 140 comprises a single extension 144 of an extension 141 of the front lower edge 142 of cuff 143. Extension 141 is situated on one of the lateral sides of shell base 2, in the proximity of the longitudinal median axis of the boot, in the zone of the instep 145. Extension 144 extends downwardly in the direction of sole 146 of shell base 2. Extension 144 is connected to shell base 2 by means of a journal 147. This journal is positioned beneath the plane 24 passing through journal axis 4, 4' of cuff 143 and through support point 20. It is within the scope of the invention to provide two elastic elements 140 and 140', respectively provided on each of the lateral sides of shell base 2 and on each side of the median longitudinal axis of the boot. In FIG. 19, extension 141, which comprises the zone in which support point 20 is located, can be positioned at any location on the lower front edge 142 of cuff 152 other than in the zone of the instep 145, and particularly, in this embodiment, substantially at mid-distance between the instep and journal axis 4, 4' of the cuff. In the embodiment seen in FIG. 20, extension 160 is positioned approximately at the same height as the journal axis 4, 4', and extension 161, which comprises elastic element 162, can have various forms such as an inverted U, provided with flexion zones. Finally, in the embodiment illustrated in FIG. 21, elastic element 170 can also be provided in the form of a flexible lateral ring integral with shell base 2 by means of a rivet 171. Elastic element 170 is integral with lower edge 172 of cuff 173 by means of two extensions 174, 174' which connect element 170 to cuff 173. These extensions comprise the edges of the ring. In this particular embodiment, each extension 174 and 174' has a retention zone in which is situated a support point 20.

Figures 22, 23:
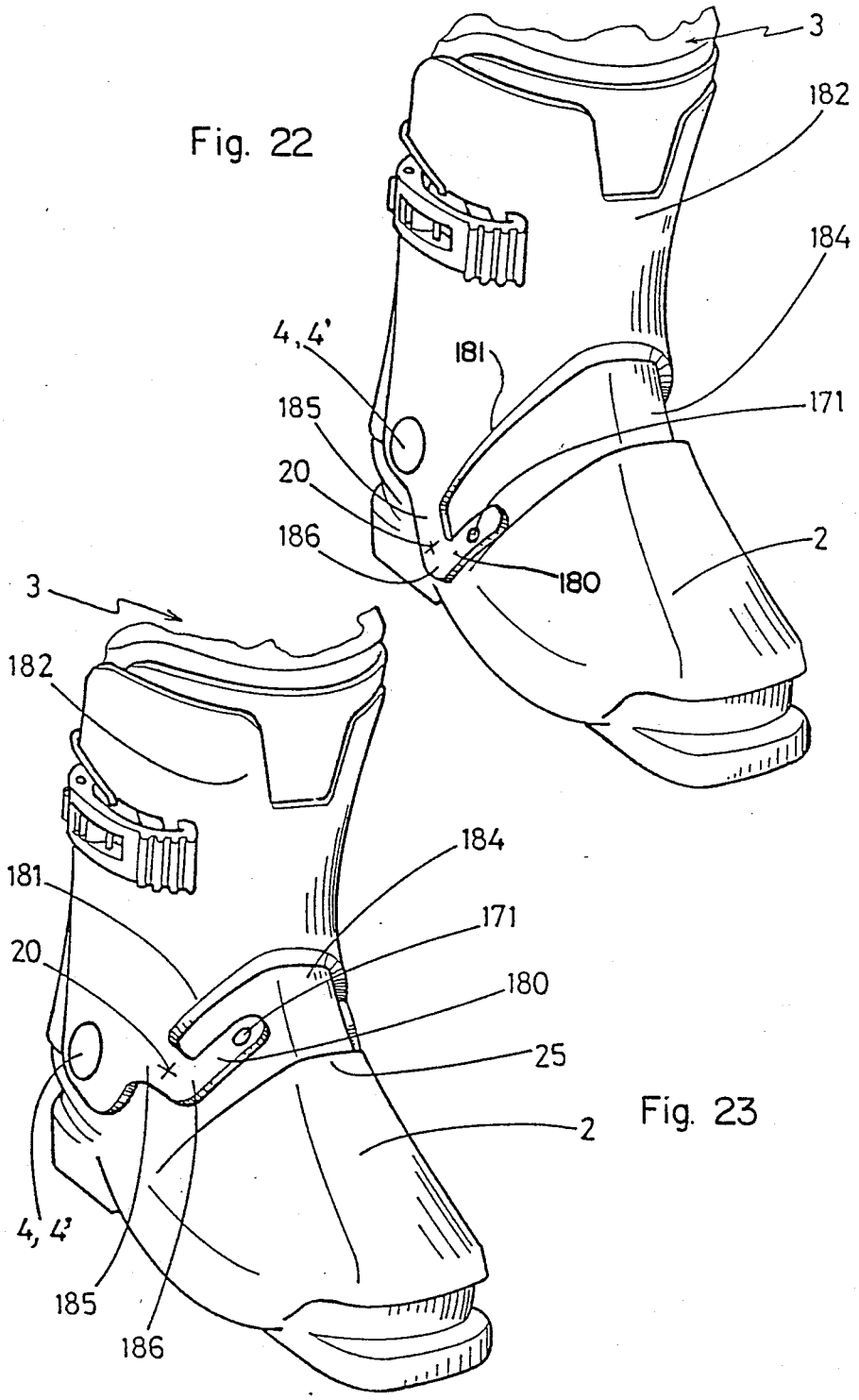
FIGS. 22 and 23 illustrate perspective views of alternative embodiments of the elastic element in which the support zone of the elastic element on the cuff is formed by an extension of the lower edge of the cuff at a point situated beneath the plane passing through the journal axis of the upper and the connection or linkage point of the elastic element to the shell base.

In the embodiment illustrated in FIGS. 22 and 23 elastic element 180 is formed by an extension 186 and can be oriented from the lower edge 181 of cuff 182 upwardly, in the direction of the zone of instep 184. In this embodiment, the support point 20 comprises an extension 185 of the lower edge 181 of the cuff.

Without going beyond the scope of the invention, upper 3 of the ski boot, according to the various embodiments illustrated in FIGS. 1–23, can be journalled on a shell base 2 by any means other than journals 4 and 4', and more particularly, upper 3 can be journalled on journals and along axes which are different than those of cuffs 5, 39, 48, 56, 66, 92, 103, 119, 127, 132, 143, 152, 173 and 182.

Of course, it should be understood that although the invention has been described with respect to certain means, methods, and embodiments, the invention is not limited thereto, but extends to all equivalents as well as their combinations within the scope of the claims.

What is claimed is:

1. A ski boot comprising:

(a) a shell base;

(b) an upper adapted to engage the lower leg of a skier, wherein said upper is at least partially journalled on said shell base around a pivot axis so as to permit flexion of said upper with respect to said shell base; and (c) means for controlling said flexion of said upper, wherein said flexion control means is mounted to operate in compression upon forward flexion of said upper, and is attached to said shell base at a predetermined distance from said pivot axis at a linkage point, wherein said flexion control means is connected to said upper at a support point, wherein said flexion control means extends within a substantially vertical plane with respect to the plane of the sole of said ski boot, said flexion control means comprises means:

for maintaining a substantially invariant distance from said pivot axis to said support point during forward flexion of said upper;

for maintaining a substantially invariant distance from said pivot axis to said linkage point during forward flexion of said upper; and for varying the distance from said support point to said linkage point during forward flexion of said upper.

2. The boot defined by claim 1 whereby said boot comprises a rear-entry ski boot, wherein said shell base comprises a rigid shell base comprising at least one lateral side, wherein said upper comprises a cuff comprising a lower peripheral edge, wherein said upper further comprises a rear spoiler adapted to open rearwardly to permit entry of said leg into said boot, wherein said flexion control means is positioned between said shell base and said upper, wherein said boot comprises an instep, wherein said flexion control means is positioned and extends at least into a portion of the periphery of said instep, wherein said flexion control means comprises means for generating a force opposing forward flexion of said upper and further comprises at least one elastic element extending substantially transversely to the longitudinal axis of said boot, wherein said at least one elastic element comprises at least one end, said boot further comprising means for linking said at least one elastic element to said shell base at said linkage point, wherein said linkage means links said at least one end of said at least one elastic element at least to said at least one lateral side of said shell base at said linkage point, wherein said support point is positioned at said lower peripheral edge of said cuff, whereby said at least one elastic element abuts said cuff at said lower peripheral edge of said cuff, said boot further comprising means for retaining said elastic element in contact with said lower peripheral edge of said cuff at said support point, wherein said at least one elastic element comprises first and second ends, wherein said first end is connected to said shell base by said linkage means, wherein said second end is connected to said cuff and is integral with said support point on said lower edge of said cuff.

3. The boot defined by claim 1 whereby said boot comprises a rear-entry ski boot wherein said shell base comprises a rigid shell base comprising at least one lateral side, wherein said upper comprises a cuff comprising a lower peripheral edge, wherein said upper further comprises a rear spoiler adapted to open rearwardly to permit entry of said leg into said boot, wherein said flexion control means is positioned between said shell base and said upper, wherein said boot comprises an instep, wherein said flexion control means is positioned and extends at least into a portion of the periphery of said instep, wherein said flexion control means comprises means for generating a force opposing forward flexion of said upper and further comprises at least one elastic element extending substantially transversely to the longitudinal axis of said boot, wherein said at least one elastic element comprises at least one end, said boot further comprising means for linking said at least one elastic element to said shell base at said linkage point, wherein said linkage means links said at least one end of said at least one elastic element at least to said at least one lateral side of said shell base at said linkage point, wherein said support point is positioned at said lower peripheral edge of said cuff, whereby said at least one elastic element is connected to said cuff at said lower peripheral edge of said cuff, said boot further comprising means for retaining said elastic element in contact with said lower peripheral edge of said cuff at said support point, wherein said at least one elastic element extends transversely to the longitudinal axis of said boot on one of said lateral sides of said shell base.

4. The boot defined by claim 3 wherein said at least one elastic element extends only on one of said lateral sides of said shell base.

5. The boot defined by claim 1 whereby said boot comprises a rear-entry ski boot, wherein said shell base comprises a rigid shell base comprising at least one lateral side, wherein said upper comprises a cuff comprising a lower peripheral edge, wherein said upper further comprises a rear spoiler adapted to open rearwardly to permit entry of said leg into said boot, wherein said flexion control means is positioned between said shell base and said upper, wherein said boot comprises an instep, wherein said flexion control means is positioned and extends at least into a portion of the periphery of said instep, wherein said flexion control means comprises means for generating a force opposing forward flexion of said upper and further comprises at least one elastic element extending substantially transversely to the longitudinal axis of said boot, wherein said at least one elastic element comprises at least one end, said boot further comprising means for linking said at least one elastic element to said shell base at said linkage point, wherein said linkage means links said at least one end of said at least one elastic element at least to said at least one lateral side of said shell base at said linkage point, wherein said support point is positioned at said lower peripheral edge of said cuff, whereby said at least one elastic element is connected to said cuff at said lower peripheral edge of said cuff, said boot further comprising means for retaining said elastic element in contact with said lower peripheral edge of said cuff at said support point, wherein said linkage point is positioned in a zone beneath a plane extending through said pivot axis and said support point, wherein said retaining means comprises an extension of said lower edge of said cuff for retaining a portion of said at least one elastic element, wherein said extension further comprises an abutment for retaining a portion of said at least one elastic element, wherein said portion of said at least one elastic element comprises a median portion of said at least one elastic element.

6. The boot defined by claim 1 whereby said boot comprises a rear-entry ski boot, wherein said shell base comprises a rigid shell base comprising at least one lateral side, wherein said upper comprises a cuff comprising a lower peripheral edge, wherein said upper further comprises a rear spoiler adapted to open rearwardly to permit entry of said leg into said boot, wherein said flexion control means is positioned between said shell base and said upper, wherein said boot comprises an instep, wherein said flexion control means is positioned and extends at least into a portion of the periphery of said instep, wherein said flexion control means comprises means for generating a force opposing forward flexion of said upper and further comprises at least one elastic element extending substantially transversely to the longitudinal axis of said boot, wherein said at least one elastic element comprises at least one end, said boot further comprising means for linking said at least one elastic element to said shell base at said linkage point, wherein said linkage means links said at least one end of said at least one elastic element at least to said at least one lateral side of said shell base at said linkage point, wherein said support point is positioned at said lower peripheral edge of said cuff, whereby said at least one elastic element is connected to said cuff at said lower peripheral edge of said cuff, said boot further comprising means for retaining said elastic element in contact with said lower peripheral edge of said cuff at said support point, wherein said linkage point is positioned in a zone beneath a plane extending through said pivot axis and said support point, wherein said retaining means comprises an extension of said lower edge of said cuff for retaining a portion of said at least one elastic element, wherein said extension further comprises an abutment for retaining a portion of said at least one elastic element, wherein said retention means comprises a linkage journal, wherein said linkage journal maintains the position of said portion of said at least one elastic element relative to said cuff.

7. The boot defined by claim 6 wherein said linkage journal comprises a nut and a bolt, wherein said bolt extends through said portion of said at least one elastic element, wherein said portion comprises the median portion of said at least one elastic element.

8. The boot defined by claim 6 wherein said at least one elastic element comprises two ends, one end of which is attached to said cuff by said linkage journal and the other end of which is attached to said shell base.

9. The boot defined by claim 8 wherein said at least one elastic element comprises a longitudinally extending slot therein.

10. The boot defined by claim 9 further comprising a ring surrounding that portion of said at least one elastic element comprising said slot, wherein the position of said ring is adjustable in the longitudinal direction of said at least one elastic element, whereby the elastic resistance of said at least one elastic element is adjusted in response to adjusting the longitudinal position of said ring.

11. The boot defined by claim 6 wherein said cuff comprises an extension positioned under said portion of said at least one elastic element, wherein said linkage journal extends through said portion of said at least one elastic element and through said extension.

12. The boot defined by claim 1 whereby said boot comprises a rear-entry ski boot, wherein said shell base comprises a rigid shell base comprising at least one lateral side, wherein said upper comprises a cuff comprising a lower peripheral edge, wherein said upper further comprises a rear spoiler adapted to open rearwardly to permit entry of said leg into said boot, wherein said flexion control means is positioned between said shell base and said upper, wherein said boot comprises an instep, wherein said flexion control means is positioned and extends at least into a portion of the periphery of said instep, wherein said flexion control means comprises means for generating a force opposing forward flexion of said upper and further comprises at least one elastic element extending substantially transversely to the longitudinal axis of said boot, wherein said at least one elastic element comprises at least one end, said boot further comprising means for linking said at least one elastic element to said shell base at said linkage point, wherein said linkage means links said at least one end of said at least one elastic element at least to said at least one lateral side of said shell base at said linkage point, wherein said support point is positioned at said lower peripheral edge of said cuff, whereby said at least one elastic element is connected to said cuff at said lower peripheral edge of said cuff, said boot further comprising means for retaining said elastic element in contact with said lower peripheral edge of said cuff at said support point, wherein said linkage point is positioned in a zone beneath a plane extending through said pivot axis and said support point, said boot further comprising a linkage journal supported on said at least one elastic element linking said at least one elastic element with said lower edge of said cuff, wherein said lower edge of said cuff comprises a cut-out portion abutting said at least one elastic element, wherein said retention means comprises said linkage journal and said cut-out portion said cuff.

13. The boot defined by claim 1 whereby said boot comprises a rear-entry ski boot, wherein said shell base comprises a rigid shell base comprising at least one lateral side, wherein said upper comprises a cuff comprising a lower peripheral edge, wherein said upper further comprises a rear spoiler adapted to open rearwardly to permit entry of said leg into said boot, wherein said flexion control means is positioned between said shell base and said upper, wherein said boot comprises an instep, wherein said flexion control means is positioned and extends at least into a portion of the periphery of said instep, wherein said flexion control means comprises means for generating a force opposing forward flexion of said upper and further comprises at least one elastic element extending substantially transversely to the longitudinal axis of said boot, wherein said at least one elastic element comprises at least one end, said boot further comprising means for linking said at least one elastic element to said shell base at said linkage point, wherein said linkage means links said at least one end of said at least one elastic element at least to said at least one lateral side of said shell base at said linkage point, wherein said support point is positioned at said lower peripheral edge of said cuff, whereby said at least one elastic element is connected to said cuff at said lower peripheral edge of said cuff, said boot further comprising means for retaining said elastic element in contact with said lower peripheral edge of said cuff at said support point, wherein said linkage point is positioned in a zone beneath a plane extending through said pivot axis and said support point, wherein said retention means comprises an extension comprising an integral portion of said lower peripheral edge of said cuff, wherein said extension comprises said at least one elastic element.

14. The boot defined by claim 13 wherein said extension comprises two elastic element extensions extending in opposite directions transverse to and on either side of the longitudinal median axis of said boot, wherein each elastic element extension comprises an end, wherein said boot further comprises two rivets, each of which attaches one of said ends of said elastic element extension to said shell base.

15. The boot defined by claim 13 wherein said extension comprises a single elastic element extension extending transversely to the longitudinal axis of said boot only on one side of the median longitudinal axis of said boot.

16. The boot defined by claim 15 further comprising a sole on said shell base, wherein said support point is positioned on one of said lateral sides of said shell base in the zone of the instep of said boot, wherein said single elastic extension extends downwardly toward said sole of said boot, wherein said boot further comprises a journal linking said single elastic element extension with said shell base at said linkage point.

17. The boot defined by claim 15 wherein said support point is positioned between said instep and said pivot axis.

18. The boot defined by claim 17 wherein said support point is positioned substantially at the midpoint between said instep and said pivot axis.

19. The boot defined by claim 15 wherein said support point is positioned substantially at the same height as said pivot axis.

20. The boot defined by claim 19 wherein said single elastic element extension substantially has the shape of an inverted U, open toward the bottom of said shell base.

21. The boot defined by claim 15 wherein said boot comprises an instep, wherein said support point is positioned below said pivot axis, wherein single elastic element extension extends from said support point upwardly toward said instep.

22. The boot defined by claim 15 wherein said boot comprises an instep, wherein said support point is positioned above said pivot axis, wherein single elastic element extension extends from said support point upwardly toward said instep.

23. The boot defined by claim 13 wherein said at least one elastic element is in the shape of a ring comprising two elastic element extensions which extend toward each other and which are attached to said lower peripheral edge of said cuff at different support points.

24. The boot defined by claim 1 whereby said boot comprises a rear-entry ski boot, wherein said shell base comprises a rigid shell base comprising at least one lateral side, wherein said upper comprises a cuff comprising a lower peripheral edge, wherein said upper further comprises a rear spoiler adapted to open rearwardly to permit entry of said leg into said boot, wherein said flexion control means is positioned between said shell base and said upper, wherein said boot comprises an instep, wherein said flexion control means is positioned and extends at least into a portion of the periphery of said instep, wherein said flexion control means comprises means for generating a force opposing forward flexion of said upper and further comprises at least one elastic element extending substantially transversely to the longitudinal axis of said boot, wherein said at least one elastic element comprises at least one end, said boot further comprising means for linking said at least one elastic element to said shell base at said linkage point, wherein said linkage means links said at least one end of said at least one elastic element at least to said at least one lateral side of said shell base at said linkage point, wherein said support point is positioned at said lower peripheral edge of said cuff, whereby said at least one elastic element is connected to said cuff at said lower peripheral edge of said cuff, said boot further comprising means for retaining said elastic element in contact with said lower peripheral edge of said cuff at said support point, wherein said linkage point is positioned in a zone beneath a plane extending through said pivot axis and said support point, wherein said lower edge of said cuff comprises a wall having a predetermined thickness, wherein said wall comprises a cut-out portion formed in the thickness of said wall, wherein said at least one elastic element comprises a portion adapted to engage said cut-out portion of said wall, wherein said portion of said at least one elastic element has a shape complementary to said cut-out portion, wherein said retention means comprises said cut-out portion and said complementary portion of said at least one elastic element.

25. The boot defined by claim 24 wherein said at least one elastic element comprises a deformable bar comprising first and second ends, wherein said first end comprises said complementary portion, wherein said second end is embedded in said shell base.

26. The boot defined by claim 25 wherein said bar comprises a deformation zone comprising two opposite longitudinal edges, wherein each longitudinal edge of said deformation zone has a plurality of notches therein.

27. The boot defined by claim 26 wherein a portion of said cuff and a portion of said at least one elastic element overlap each other in an overlapping zone, wherein said shell base comprises an element extending into said overlapping zone.

28. The boot defined by claim 1 whereby said boot comprises a rear-entry ski boot, wherein said shell base comprises a rigid shell base comprising at least one lateral side, wherein said upper comprises a cuff comprising a lower peripheral edge, wherein said upper further comprises a rear spoiler adapted to open rearwardly to permit entry of said leg into said boot, wherein said flexion control means is positioned between said shell base and said upper, wherein said boot comprises an instep, wherein said flexion control means is positioned and extends at least into a portion of the periphery of said instep, wherein said flexion control means comprises means for generating a force opposing forward flexion of said upper and further comprises at least one elastic element extending substantially transversely to the longitudinal axis of said boot, wherein said at least one elastic element comprises at least one end, said boot further comprising means for linking said at least one elastic element to said shell base at said linkage point, wherein said linkage means links said at least one end of said at least one elastic element at least to said at least one lateral side of said shell base at said linkage point, wherein said support point is positioned at said lower peripheral edge of said cuff, whereby said at least one elastic element is connected to said cuff at said lower peripheral edge of said cuff, said boot further comprising means for retaining said elastic element in contact with said lower peripheral edge of said cuff at said support point, wherein said linkage point is positioned in a zone above a plane extending through said pivot axis and said support point.

29. The boot defined by claim 28 wherein said retaining means comprises an extension of said lower edge of said cuff for retaining a portion of said at least one elastic element.

30. The boot defined by claim 29 wherein said extension further comprises an abutment for retaining said portion of said at least one elastic element.

31. The boot defined by claim 28 wherein said retention means comprises a linkage journal, wherein said linkage journal maintains the position of said portion of said at least one elastic element relative to said cuff.

32. The boot defined by claim 31 wherein said at least one elastic element comprises a longitudinal side, wherein said abutment comprises a shoulder engaging a portion of said longitudinal side of said at least one elastic element.

33. The boot defined by claim 28 further comprising a linkage journal supported on said at least one elastic element linking said at least one elastic element with said lower edge of said cuff, wherein said lower edge of said cuff comprises a cut-out portion abutting said at least one elastic element, wherein said retention means comprises said linkage journal and said cut-out portion said cuff.

34. The boot defined by claim 28 wherein said retention means comprises an extension comprising an integral portion of said lower peripheral edge of said cuff, wherein said extension comprises said at least one elastic element.

35. The boot defined by claim 1 whereby said boot comprises a rear-entry ski boot, wherein said shell base comprises a rigid shell base comprising at least one lateral side, wherein said upper comprises a cuff comprising a lower peripheral edge, wherein said upper further comprises a rear spoiler adapted to open rearwardly to permit entry of said leg into said boot, wherein said flexion control means is positioned between said shell base and said upper, wherein said boot comprises an instep, wherein said flexion control means is positioned and extends at least into a portion of the periphery of said instep, wherein said flexion control means comprises means for generating a force opposing forward flexion of said upper and further comprises at least one elastic element extending substantially transversely to the longitudinal axis of said boot, wherein said at least one elastic element comprises at least one end, said boot further comprising means for linking said at least one elastic element to said shell base at said linkage point, wherein said linkage means links said at least one end of said at least one elastic element at least to said at least one lateral side of said shell base at said linkage point, wherein said support point is positioned at said lower peripheral edge of said cuff, whereby said at least one elastic element is connected to said cuff at said lower peripheral edge of said cuff, said boot further comprising means for retaining said elastic element in contact with said lower peripheral edge of said cuff at said support point, said boot further comprising two journals for connecting said at least one elastic element to said shell base at two linkage points, wherein said boot comprises an instep, wherein said retention means comprises an extension comprising an integral portion of said lower peripheral edge of said cuff, wherein said extension comprises said at least one elastic element, wherein said extension comprises:

a first extension; and second and third extensions, wherein said first extension extends from said lower peripheral edge of said cuff and connects said second and third extensions to said cuff, wherein said first extension is positioned substantially in the median longitudinal axis of said boot, wherein said second and third extensions extend symmetrically from said first extension in a zone surrounding said foot, beginning at said instep, wherein said second and third extensions are each connected to said shell base at a linkage point by one of said journals.

36. The boot defined by claim 1 whereby said boot comprises a rear-entry ski boot, wherein said shell base comprises a rigid shell base comprising at least one lateral side, wherein said upper comprises a cuff comprising a lower peripheral edge, wherein said upper further comprises a rear spoiler adapted to open rearwardly to permit entry of said leg into said boot, wherein said flexion control means is positioned between said shell base and said upper, wherein said boot comprises an instep, wherein said flexion control means is positioned and extends at least into a portion of the periphery of said instep, wherein said flexion control means comprises means for generating a force opposing forward flexion of said upper and further comprises at least one elastic element extending substantially transversely to the longitudinal axis of said boot, wherein said at least one elastic element comprises at least one end, said boot further comprising means for linking said at least one elastic element to said shell base at said linkage point, wherein said linkage means links said at least one end of said at least one elastic element at least to said at least one lateral side of said shell base at said linkage point, wherein said support point is positioned at said lower peripheral edge of said cuff, whereby said at least one elastic element is connected to said cuff at said lower peripheral edge of said cuff, said boot further comprising means for retaining said elastic element in contact with said lower peripheral edge of said cuff at said support point, wherein said boot comprises an instep, wherein said retention means comprises and extension comprising an integral portion of said lower peripheral edge of said cuff, wherein said extension comprises said at least one elastic element, wherein said extension comprises:

a first extension extending from said lower peripheral edge of said cuff; and a second extension attached to said first extension, wherein said first extension connects said second extension to said cuff, wherein said first extension is positioned at any point on the periphery of the skier's foot on said lower edge of said cuff in a zone extending from said instep to said pivot axis.

37. The boot defined by claim 36 wherein said second extension extends beyond said first extension generally in a direction downwardly from said first extension.

38. The boot defined by claim 36 wherein said second extension extends from said first extension and has substantially the shape of an inverted U, wherein said second extension comprises said at least one elastic element, wherein said linkage point is substantially at the same height as said pivot axis.

39. The boot defined by claim 36 wherein said second extension extends beyond said first extension, wherein said second extension has substantially the shape of a reversed L when said boot is viewed from the front toward the rear, wherein said second extension comprises said at least one elastic element, wherein said second extension extends generally upwardly from said first extension.

40. The boot defined by claim 36 wherein said at least one elastic element is positioned on one side of the median longitudinal axis of said boot on said shell base.

41. The boot defined by claim 40 wherein said at least one elastic element comprises a first portion and a second portion, wherein said first portion is positioned on one side of said median longitudinal axis of said boot on said shell base, wherein said second portion is positioned on the other side of said median longitudinal axis of said boot on said shell base.

42. The boot defined by claim 41 wherein said first portion has different elastic characteristics than said second portion.

43. The boot defined by claim 1 whereby said boot comprises a rear-entry ski boot, wherein said shell base comprises a rigid shell base comprising at least one lateral side, wherein said upper comprises a cuff comprising a lower peripheral edge, wherein said upper further comprises a rear spoiler adapted to open rearwardly to permit entry of said leg into said boot, wherein said flexion control means is positioned between said shell base and said upper, wherein said boot comprises an instep, wherein said flexion control means is positioned and extends at least into a portion of the periphery of said instep, wherein said flexion control means comprises means for generating a force opposing forward flexion of said upper and further comprises at least one elastic element extending substantially transversely to the longitudinal axis of said boot, wherein said at least one elastic element comprises at least one end, said boot further comprising means for linking said at least one elastic element to said shell base at said linkage point, wherein said linkage means links said at least one end of said at least one elastic element at least to said at least one lateral side of said shell base at said linkage point, wherein said support point is positioned at said lower peripheral edge of said cuff, whereby said at least one elastic element is connected to said cuff at said lower peripheral edge of said cuff, said boot further comprising means for retaining said elastic element in contact with said lower peripheral edge of said cuff at said support point, wherein said at least one elastic element has substantially the shape of a ring integral with said cuff, wherein said substantially ring-shaped at least one elastic element comprises first and second extensions integral with said lower peripheral edge of said cuff, wherein said boot further comprises a journal connecting said at least one elastic element to said shell base, wherein said first and second extensions meet at said journal, wherein said journal is spaced a predetermined distance from said pivot axis on one of the lateral sides of said shell base.

44. The boot defined by claim 43 wherein said substantially ring-shaped at least one elastic element extends on each side of the median longitudinal axis of said boot on said shell base.

45. The boot defined by claim 1 whereby said boot has a vertical longitudinal median plane, and wherein said support point is positioned between a journal of said of said upper around said pivot axis and said longitudinal median plane.

46. The boot defined by claim 45 wherein said support point is positioned approximately mid-length between a journal of said upper around said pivot axis and said longitudinal median plane.

47. An apparatus for controlling the flexion of the upper of a boot on the shell base of the boot, wherein said upper is at least partially journalled on said shell base around a pivot axis so as to permit flexion of said upper with respect to said shell base, said apparatus comprising:

a flexion control device for controlling said flexion of said upper, wherein said flexion control device is attached to said shell base at a predetermined distance from said pivot axis at a linkage point, wherein said flexion control device is connected to said upper at a support point, said support point being positioned between a journal of said shell base, around said pivot axis, and a vertical longitudinal median plane of said boot, wherein said flexion control device is so attached to said boot that said device comprises means:

for maintaining a substantially invariant distance from said pivot axis to said support point during flexion of said upper;

for maintaining a substantially invariant distance from said pivot axis to said linkage point during flexion of said upper; and for varying the distance from said support point to said linkage point during flexion of said upper.

48. The apparatus defined by claim 47 wherein said support point is positioned approximately mid-length between a journal of said upper around said pivot axis and said longitudinal median plane.

49. The apparatus defined by claim 47 wherein said flexion control device comprises an elastic element extending from said linkage point to said support point substantially within a plane which is perpendicular to the sole of said boot.

50. The apparatus defined by claim 49 wherein said flexion control device comprises an elastic element on either side of said vertical longitudinal median plane, each having a respective linkage point and a respective support point.

51. The apparatus defined by claim 50 wherein said elastic elements are compressed upon forward flexion of said upper.

* * * * *

UNITED STATES PATENT AND TRADEMARK OFFICE

CERTIFICATE OF CORRECTION

PATENT NO. : 4,901,455

DATED : Feb. 20, 1990

INVENTOR(S) : J. MORELL et al.

It is certified that error appears in the above-identified patent and that said Letters Patent is hereby corrected as shown below:

column 1, line 54, insert —the— after "by";
column 3, line 58, insert —of— after "portion";
column 8, line 18, change "he" to —the—;
column 10, line 67, change "With" to —with—;
column 12, line 43, insert —the— after "to";
column 16, line 57, insert —base— after "shell";
column 17, line 61, change "30" to —130—; and
column 28, line 2, in claim 45, line 4, change "said of said" to —said—.

Signed and Sealed this

Twenty-fourth Day of September, 1991

*Attest:*

HARRY F. MANBECK, JR.

*Attesting Officer*

*Commissioner of Patents and Trademarks*